US009705229B2

(12) United States Patent
Itou

(10) Patent No.: US 9,705,229 B2
(45) Date of Patent: Jul. 11, 2017

(54) CONNECTOR ASSEMBLY

(71) Applicant: JAPAN AVIATION ELECTRONICS INDUSTRY, LTD., Tokyo (JP)

(72) Inventor: Yasukazu Itou, Tokyo (JP)

(73) Assignee: JAPAN AVIATION ELECTRONICS INDUSTRY, LTD., Tokyo (JP)

( * ) Notice: Subject to any disclaimer, the term of this patent is extended or adjusted under 35 U.S.C. 154(b) by 0 days.

(21) Appl. No.: 15/122,193

(22) PCT Filed: Mar. 5, 2015

(86) PCT No.: PCT/JP2015/001183
§ 371 (c)(1),
(2) Date: Aug. 29, 2016

(87) PCT Pub. No.: WO2015/133145
PCT Pub. Date: Sep. 11, 2015

(65) Prior Publication Data

US 2016/0372855 A1 Dec. 22, 2016

(30) Foreign Application Priority Data

Mar. 7, 2014 (JP) ..... 2014-045241

(51) Int. Cl.
*H01R 11/09* (2006.01)
*H01R 13/44* (2006.01)
(Continued)

(52) U.S. Cl.
CPC ..... *H01R 13/44* (2013.01); *H01R 4/184* (2013.01); *H01R 13/04* (2013.01); *H01R 13/113* (2013.01);
(Continued)

(58) Field of Classification Search
CPC ..... H01R 14/644
(Continued)

(56) References Cited

U.S. PATENT DOCUMENTS 5,083,944 A 1/1992 Self, Jr.
6,749,470 B2 * 6/2004 Dangelmaier ..... H01R 13/193 439/857
(Continued)

FOREIGN PATENT DOCUMENTS

EP 2642607 A1 9/2013
JP 2008-204802 A 9/2008
(Continued)

OTHER PUBLICATIONS

International Search Report dated Jun. 2, 2015 in corresponding Application No. PCT/JP2015/001183; 1 pg.
(Continued)

*Primary Examiner* — Tulsidas C Patel
*Assistant Examiner* — Peter G Leigh
(74) *Attorney, Agent, or Firm* — Maier & Maier, PLLC

(57) ABSTRACT

A plug contact includes a plate-shaped contact portion. The plate-shaped contact portion includes an upper contact surface where a receptacle contact is contactable. A plug housing includes: a base; a pair of side end cover portions that projects in a mating direction from the base and covers both side ends of the plate-shaped contact portion; a leading end cover portion which couples leading ends of the pair of side end cover portions in the mating direction and covers a leading end of the plate-shaped contact portion; a pair of beams that couples the base with a middle portion of the leading end cover portion in a longitudinal direction; and an outside cover. The receptacle contact includes a pair of upper elastic spring pieces disposed so as to sandwich one of the beams. The receptacle contact is formed by bending a single metallic plate.

9 Claims, 27 Drawing Sheets

(51) Int. Cl.

| | |
|---|---|
| ***H01R 4/18*** | (2006.01) |
| ***H01R 13/11*** | (2006.01) |
| ***H01R 13/422*** | (2006.01) |
| ***H01R 13/04*** | (2006.01) |
| ***H01R 13/627*** | (2006.01) |

(52) U.S. Cl.
CPC ..... *H01R 13/4223* (2013.01); *H01R 13/6271* (2013.01)

(58) Field of Classification Search
USPC ..... 439/723, 79
See application file for complete search history.

(56) References Cited

U.S. PATENT DOCUMENTS 7,686,662 B2 * 3/2010 Schneider ..... H01R 4/185 439/834
8,043,097 B2 * 10/2011 Ngo ..... H01R 12/7088 439/206
8,727,796 B2 * 5/2014 Ngo ..... H01R 12/75 439/660
9,570,722 B2 * 2/2017 Ebisawa ..... H01R 13/6315
2003/0176112 A1 9/2003 Danglemaier
2011/0076901 A1 * 3/2011 Glick ..... H01R 9/245 439/839
2014/0308557 A1 10/2014 Ebisawa et al.

FOREIGN PATENT DOCUMENTS

JP 2012-515429 A 7/2012
JP 2013-140710 A 7/2013

OTHER PUBLICATIONS

Extended European Search Report dated Dec. 13, 2016, including the Supplementary European Search Report and the European Search Opinion, in connection with corresponding EP Application No. 15758567.0 (11 pgs.).

* cited by examiner

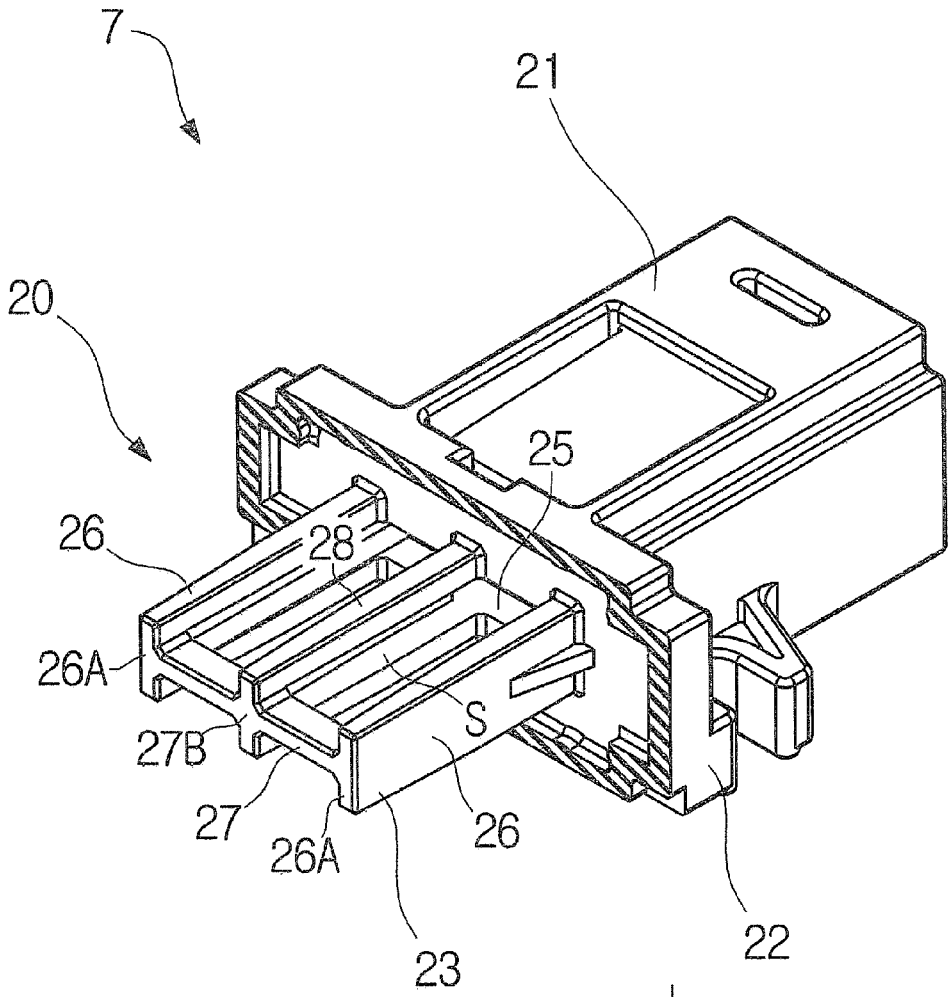
Fig. 8
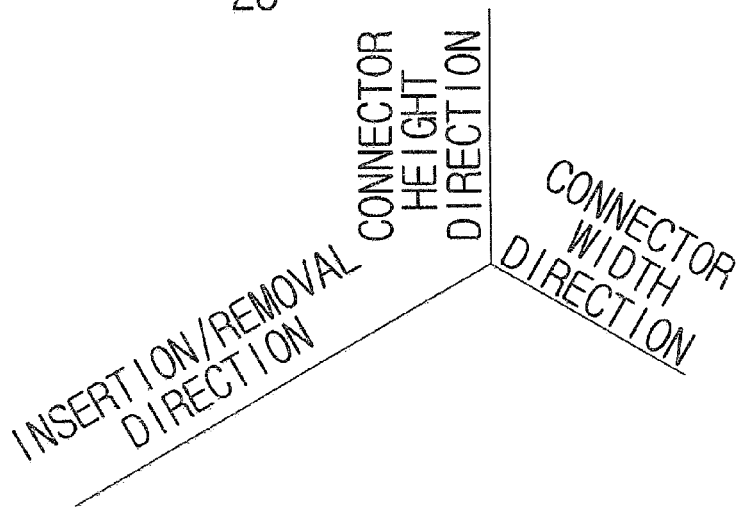

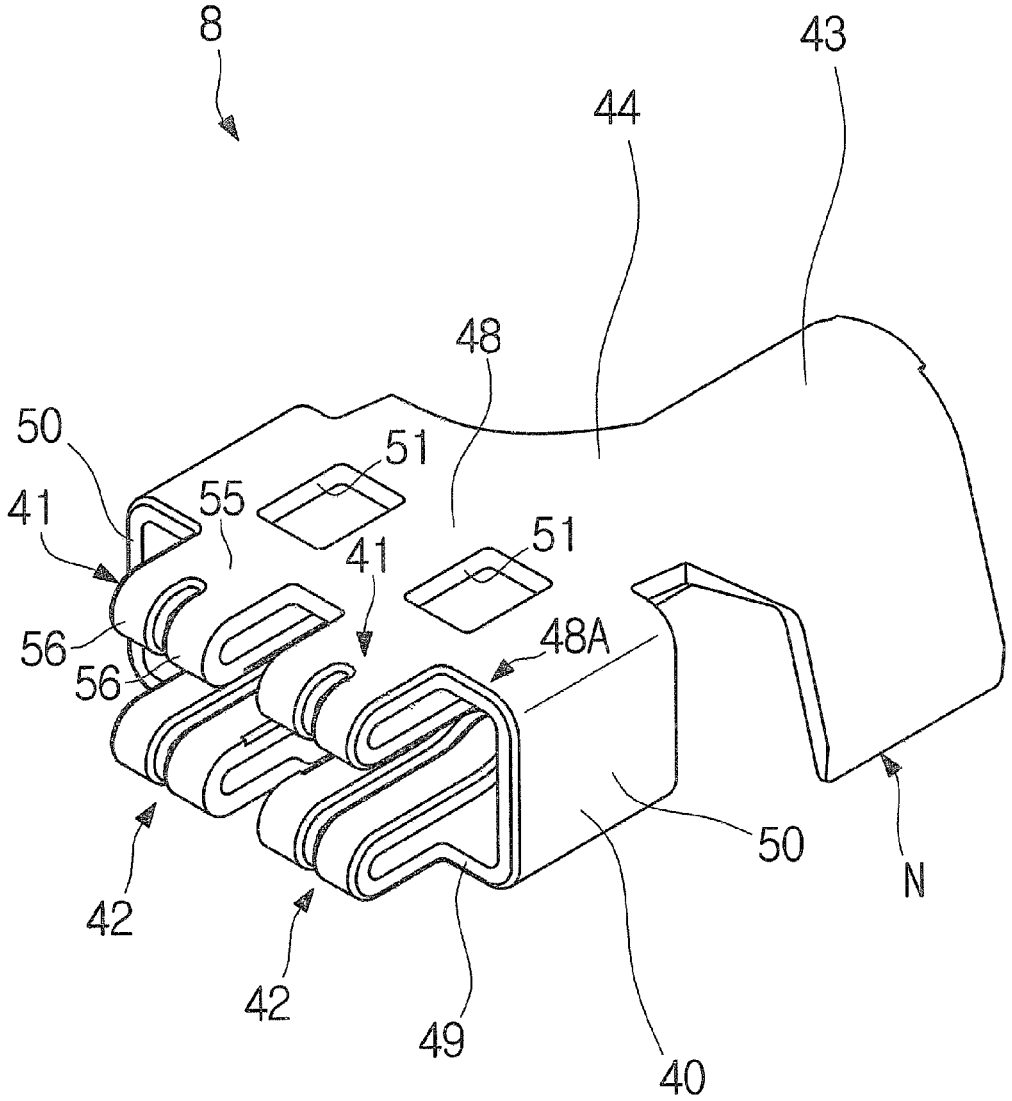
Fig. 13
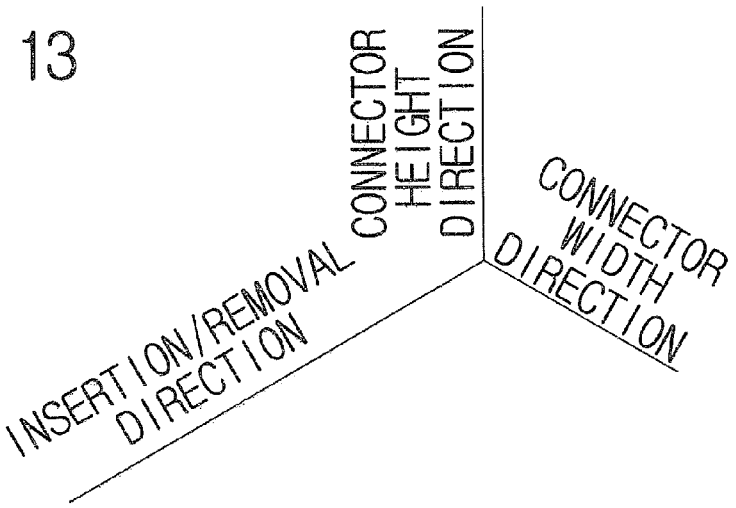

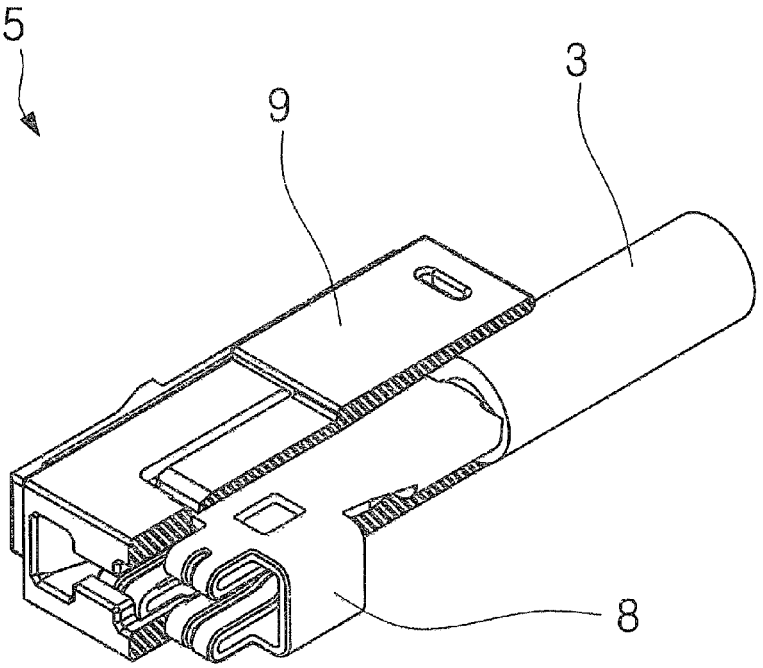
Fig. 20
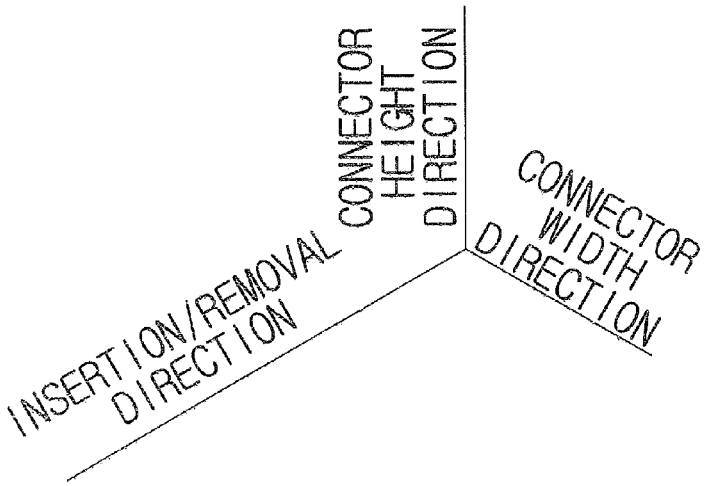

CONNECTOR ASSEMBLY

TECHNICAL FIELD

The present invention relates to a connector assembly.

BACKGROUND ART

As a technique of this type, Patent Literature 1 discloses a battery-side connector 100 and a rack-side connector 101 for electrically connecting a plurality of battery units which are inserted into a receiving rack as shown in FIG. 26 of this application. The battery-side connector 100 is a connector to be attached to each of the battery units. The battery-side connector 100 includes a battery-side housing 102 and a pair of battery-side contacts 103. Each battery-side contact 103 is partially covered by a comb-shaped covering portion 104 to prevent electric shock. The rack-side connector 101 is a connector to be attached to the receiving rack. As shown in FIG. 27 of this application, the rack-side connector 101 includes a first housing 105, a second housing 106, which is floatable with respect to the first housing 105, and sets of three rack-side contacts 107. In the above structure, when the battery-side connector 100 is mated to the rack-side connector 101, each battery-side contact 103 electrically contacts the corresponding set of three rack-side contacts 107.

CITATION LIST

Patent Literature

[Patent Literature 1] Japanese Unexamined Patent Application Publication No. 2013-140710

SUMMARY OF INVENTION

Technical Problem

As described above, Patent Literature 1 employs the structure in which all three of the set of rack-side contacts 107 contact the corresponding battery-side contact 103 at the same time. This is mainly for the purpose of improving the connection reliability by multiple contact points. In such technical fields relating to connectors, there is always a demand for reducing the number of components.

Accordingly, an object of the present invention is to provide a technique for achieving a high connection reliability as well as a reduction in the number of components.

Solution to Problem

According to an aspect of the present invention, there is provided a connector assembly including: a first connector including a first housing and a first contact held in the first housing; and a second connector including a second housing and a second contact held in the second housing, the first connector being mated to the second connector to electrically connect the first contact with the second contact. The first contact includes a plate-shaped contact portion parallel to a mating direction in which the first connector is mated to the second connector. The contact portion has a first contact surface where the second contact is contactable. The first housing includes: a first housing body; a pair of side end cover portions that projects in the mating direction from the first housing body and covers both side ends of the contact portion; a leading end cover portion that couples leading ends of the pair of side end cover portions in the mating direction and covers a leading end of the contact portion; a beam that couples the first housing body with a middle portion of the leading end cover portion in a longitudinal direction; and a housing cover portion that covers the second housing in a state where the first connector is mated to the second connector. The second contact includes a pair of first elastic spring pieces that is contactable with the first contact surface and is disposed in such a manner that the first elastic spring pieces sandwich the beam in the state where the first connector is mated to the second connector. The second contact is formed by bending a single metallic plate.

Advantageous Effects of Invention

According to the present invention, a high connection reliability as well as a reduction in the number of components can be achieved.

BRIEF DESCRIPTION OF DRAWINGS

FIG. 8 is a partially cutaway perspective view of the plug housing (first embodiment);

FIG. 13 is a perspective view of a receptacle contact (first embodiment);

FIG. 20 is a partially cutaway perspective view of a receptacle connector (first embodiment);

DESCRIPTION OF EMBODIMENTS (First Embodiment)

A first embodiment will be described below with reference to FIGS. 1 to 23.

Figure 1:
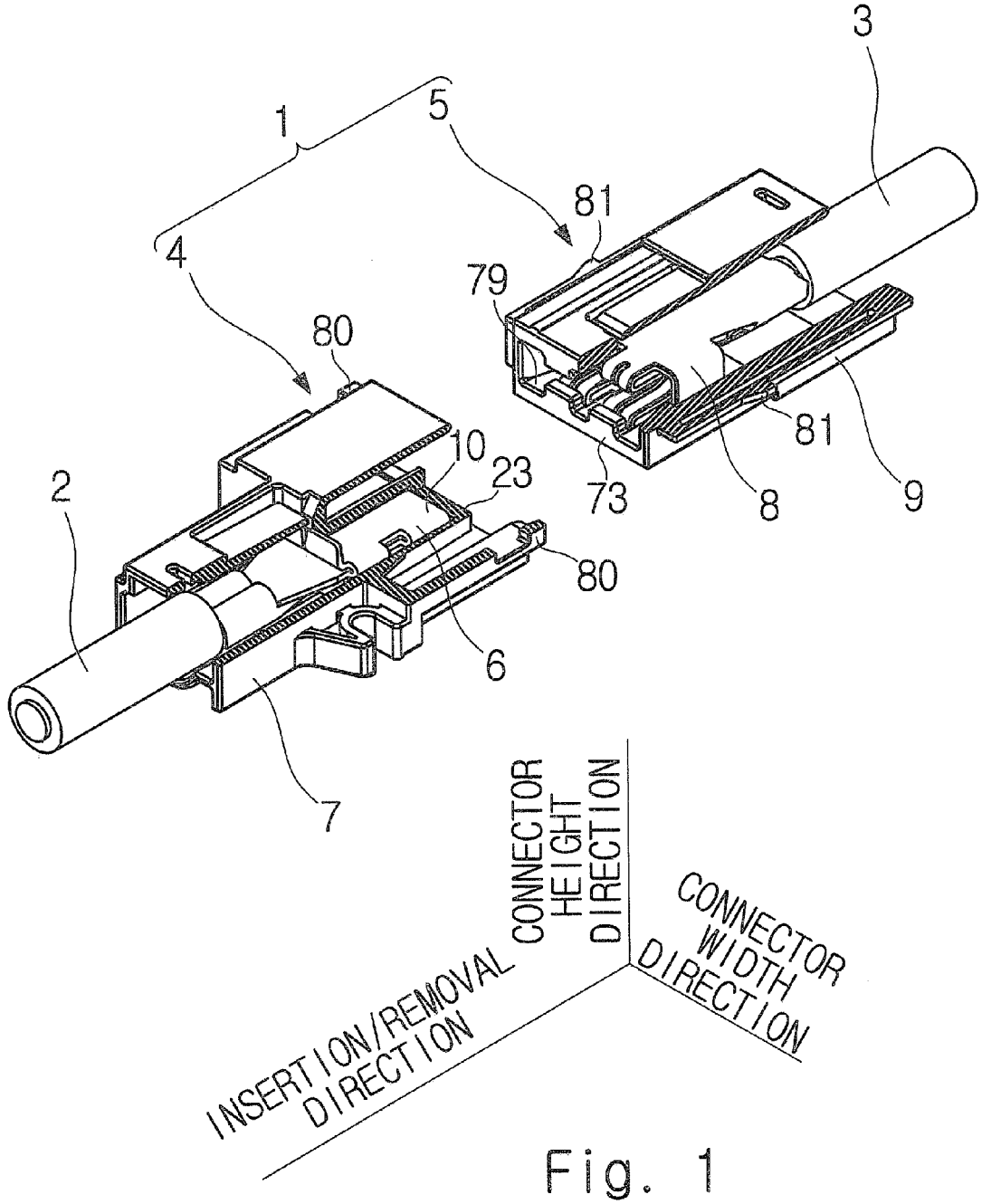
FIG. 1 is a perspective view of a connector assembly before mating (first embodiment)
Figure 2:
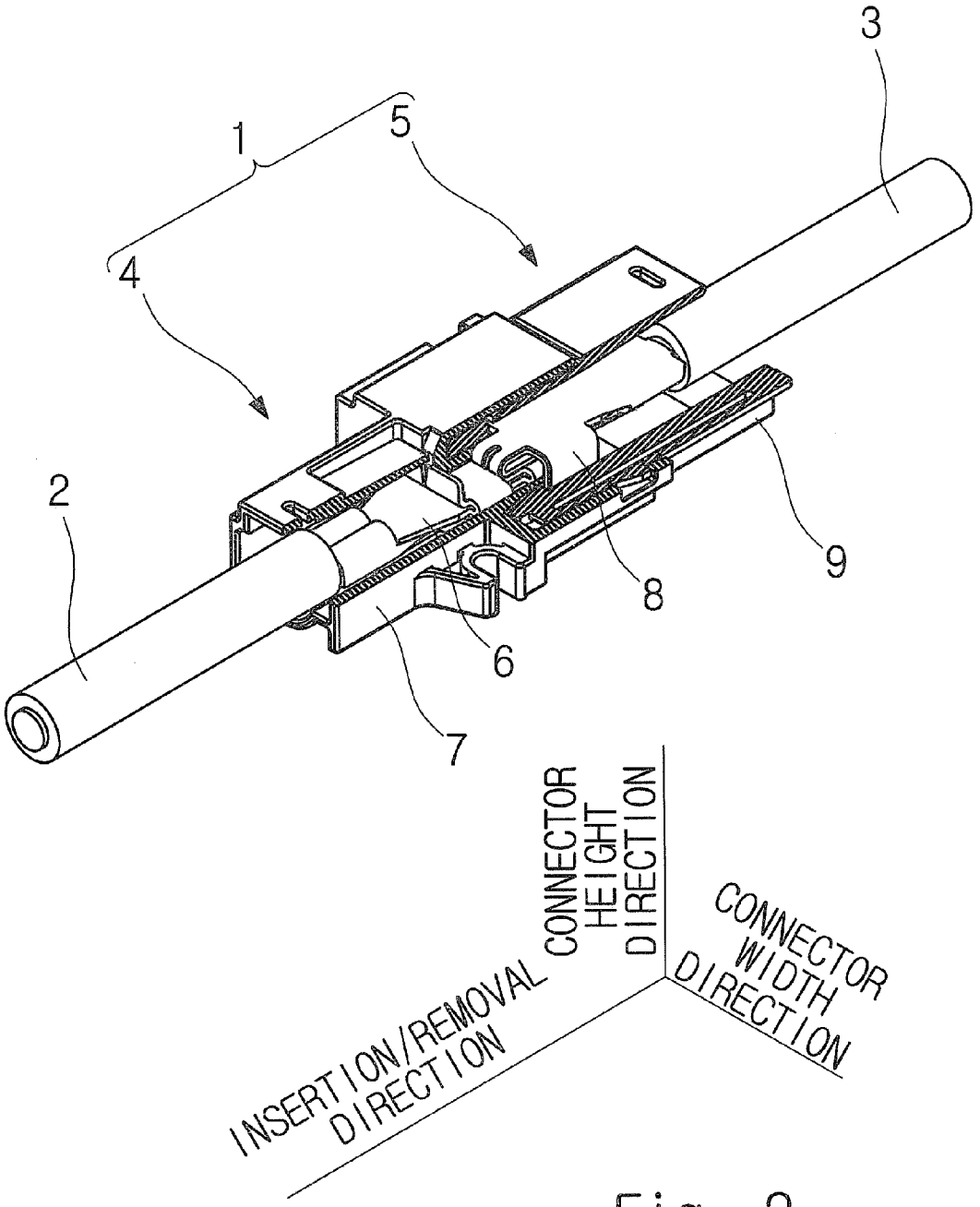
FIG. 2 is a perspective view of the connector assembly after mating (first embodiment)

FIG. 1 shows a connector assembly 1 before mating. FIG. 2 shows the connector assembly 1 after mating. The connector assembly 1 is used to electrically connect a plug-side wire 2 to a receptacle-side wire 3. The connector assembly 1 includes a plug connector 4 (first connector) to be attached to the plug-side wire 2, and a receptacle connector 5 (second connector) to be attached to the receptacle-side wire 3. The connector assembly 1 is used to, for example, connect a plurality of batteries.

As shown in FIGS. 1 and 2, the plug connector 4 includes a plug contact 6 (first contact), and a plug housing 7 (first housing) that accommodates the plug contact 6. Similarly, the receptacle connector 5 includes a receptacle contact 8 (second contact), and a receptacle housing 9 (second housing) that accommodates the receptacle contact 8. The plug connector 4 and the receptacle connector 5 will be described below in this order.

(Plug Connector 4)

Figure 3:
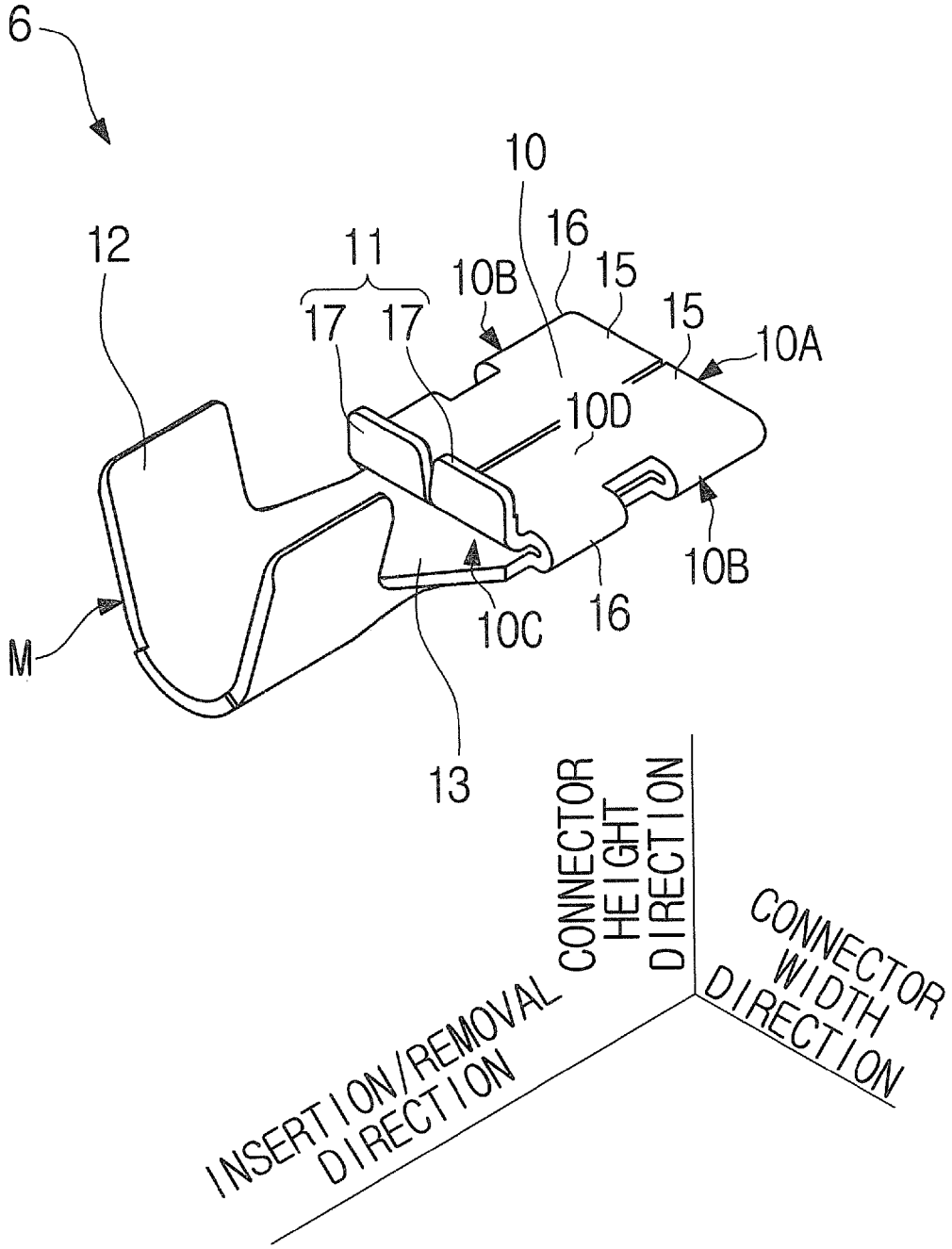
FIG. 3 is a perspective view of a plug contact (first embodiment)
Figure 4:
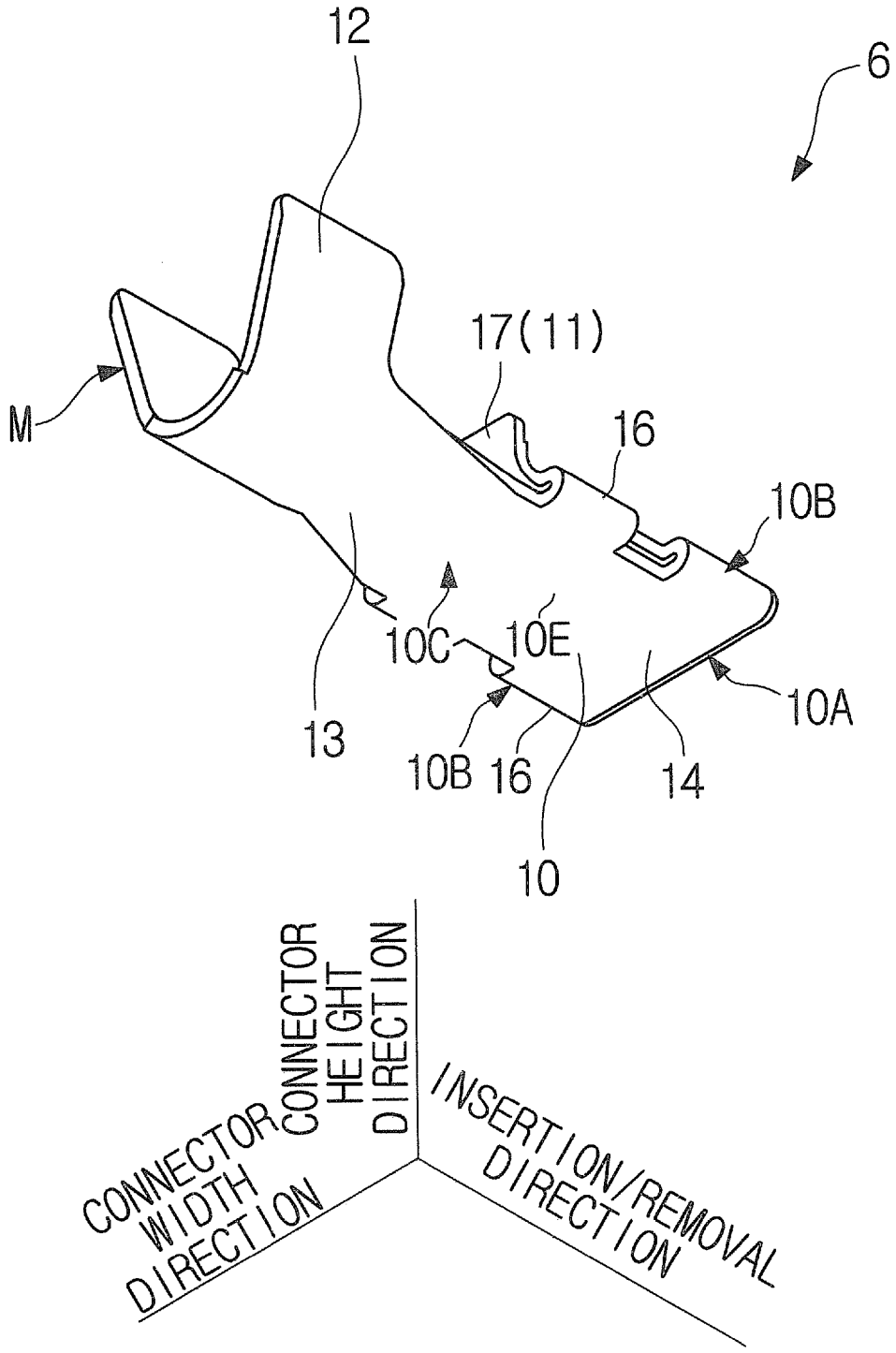
FIG. 4 is a perspective view of the plug contact as viewed from another angle (first embodiment)
Figure 5:
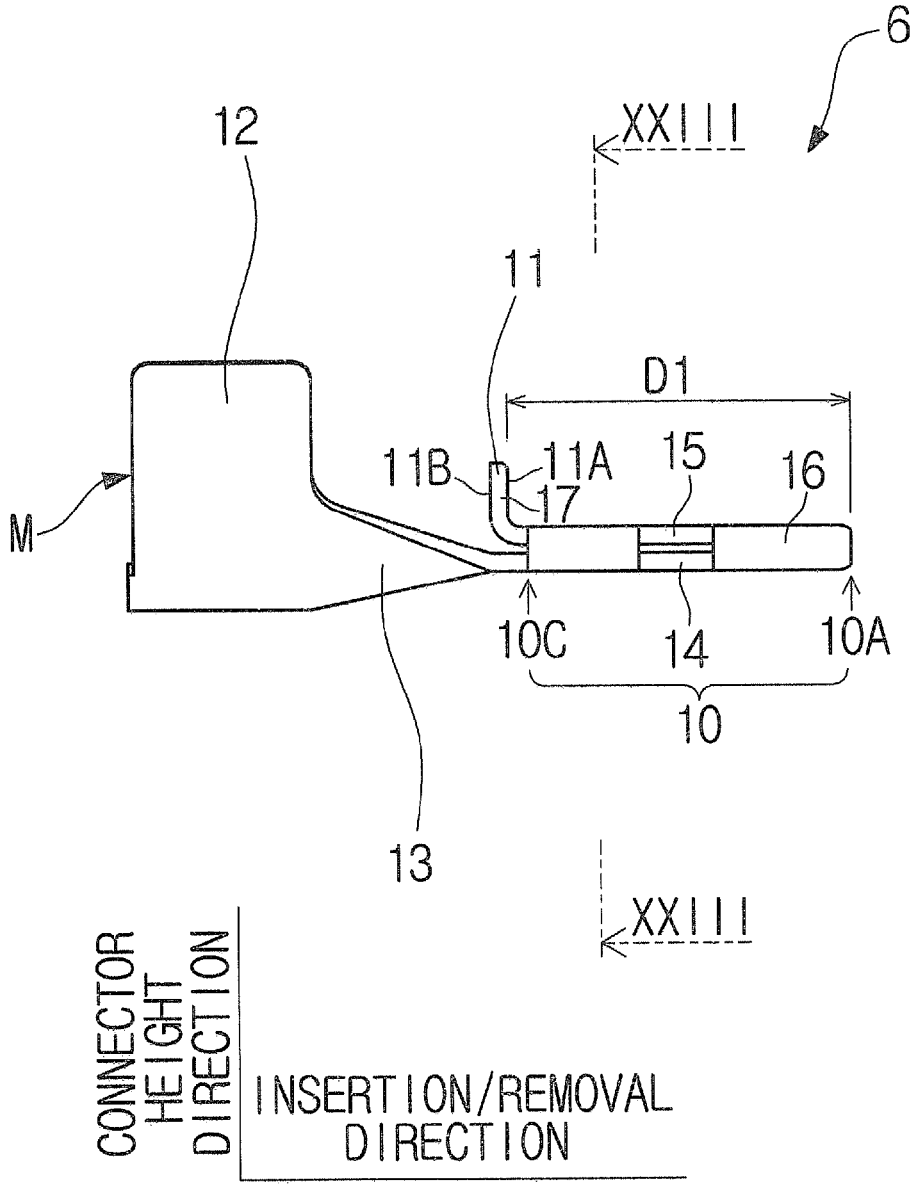
FIG. 5 is a side view of the plug contact (first embodiment)

FIGS. 3 to 5 show the plug contact 6. As shown in FIGS. 3 to 5, the plug contact 6 includes a plate-shaped contact portion 10 (contact portion), which is formed in a plate shape, a movement regulating portion 11, an open-barrel-type crimping portion 12, and a coupling portion 13 that couples the plate-shaped contact portion 10 with the crimping portion 12. The plug contact 6 is integrally formed by bending a single metallic plate M.

Referring again to FIG. 1, the terms "insertion/removal direction", "connector height direction", and "connector width direction" will now be defined. The insertion/removal direction is a direction including a mating direction and a removal direction. The mating direction is a direction in which the plug connector 4 is mated to the receptacle connector 5, and the removal direction is a direction in which the plug connector 4 is removed from the receptacle connector 5. The connector height direction is a direction parallel to the thickness direction of the plate-shaped contact portion 10. The connector height direction includes an upward direction and a downward direction. The connector width direction is a direction orthogonal to the insertion/removal direction and the connector height direction. The connector width direction includes a connector width center direction and a connector width anti-center direction. The connector width center direction is a direction toward the center of the plate-shaped contact portion 10. The connector width anti-center direction is a direction away from the center of the plate-shaped contact portion 10.

As shown in FIG. 3, the plate-shaped contact portion 10 is formed into a plate shape by folding a single metallic plate M back. The plate-shaped contact portion 10 has a leading end 10A in the mating direction, a pair of side ends 10B in the connector width direction, and a trailing end 10C in the mating direction. As shown in FIGS. 3 and 4, the plate-shaped contact portion 10 includes an upper contact surface 10D (first contact surface) facing in the upward direction, and a lower contact surface 10E (second contact surface) facing in the downward direction. As shown in FIGS. 3 and 4, the plate-shaped contact portion 10 includes a lower contact portion 14 and a pair of upper contact portions 15. As shown in FIG. 3, the upper contact portions 15 are adjacent to each other in the connector width direction, and are opposed to the lower contact portion 14 in the connector height direction. The upper contact portions 15 are connected to the lower contact portion 14 shown in FIG. 4 at the side ends 10B, respectively. In other words, a pair of folds 16 formed when the plate-shaped contact portion 10 is formed is parallel to the mating direction.

As shown in FIG. 3, the movement regulating portion 11 is formed so as to project in the upward direction from the trailing end 10C of the plate-shaped contact portion 10. As shown in FIG. 5, the movement regulating portion 11 includes a first movement regulating surface 11A facing in the mating direction, and a second movement regulating surface 11B facing in the removal direction. As shown in FIG. 3, the movement regulating portion 11 includes a pair of regulation pieces 17. Each of the pair of regulation pieces 17 is connected to a corresponding one of the pair of upper contact portions 15 at the trailing end 10C. As shown in FIG. 5, the distance between the first movement regulating surface 11A of the movement regulating portion 11 and the leading end 10A of the plate-shaped contact portion 10 in the insertion/removal direction is defined as a distance D1.

The crimping portion 12 shown in FIG. 3 is a portion where the conductor of the plug-side wire 2 shown in FIG. 1 is crimped.

Figure 6:
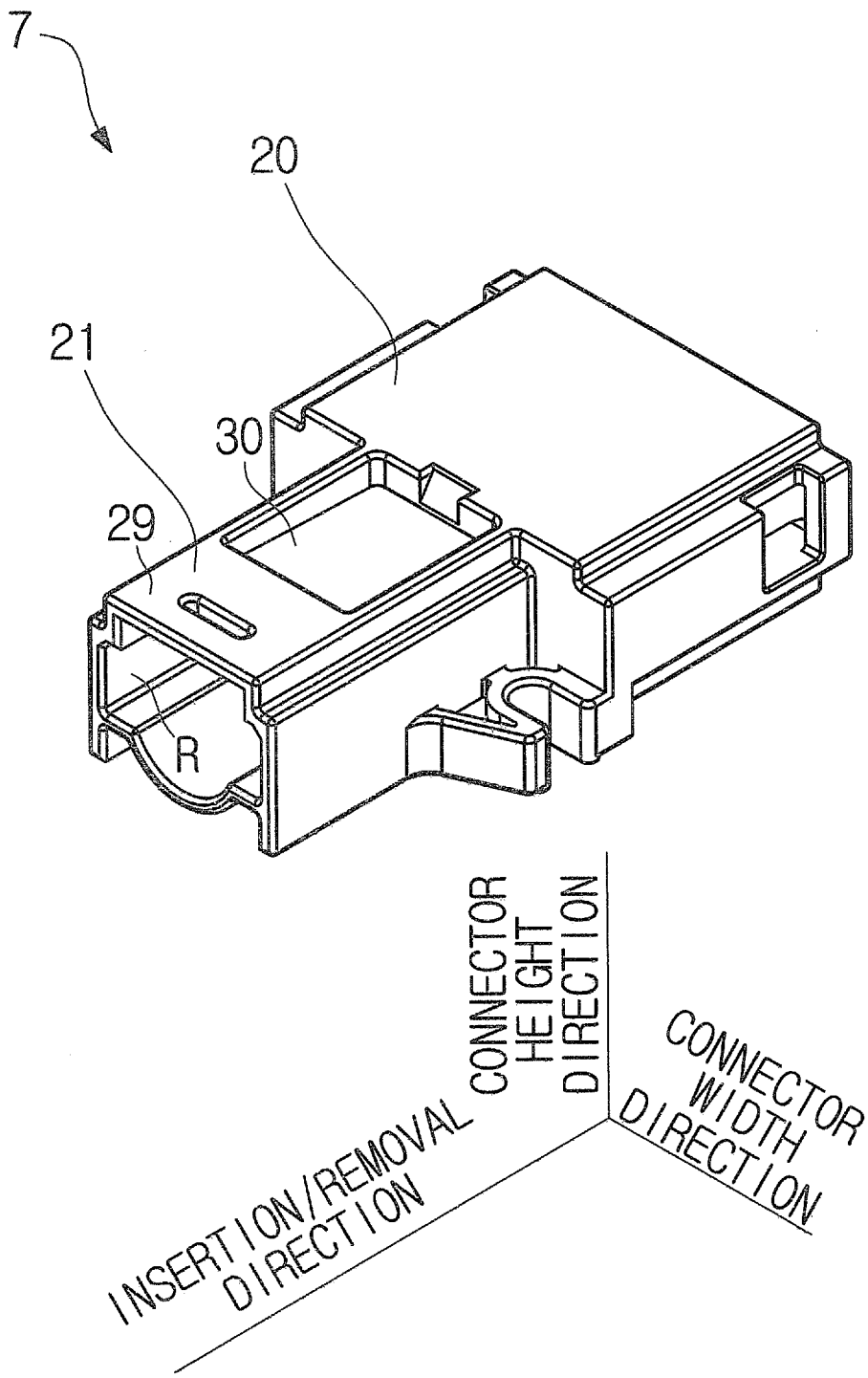
FIG. 6 is a perspective view of a plug housing (first embodiment)
Figure 7:
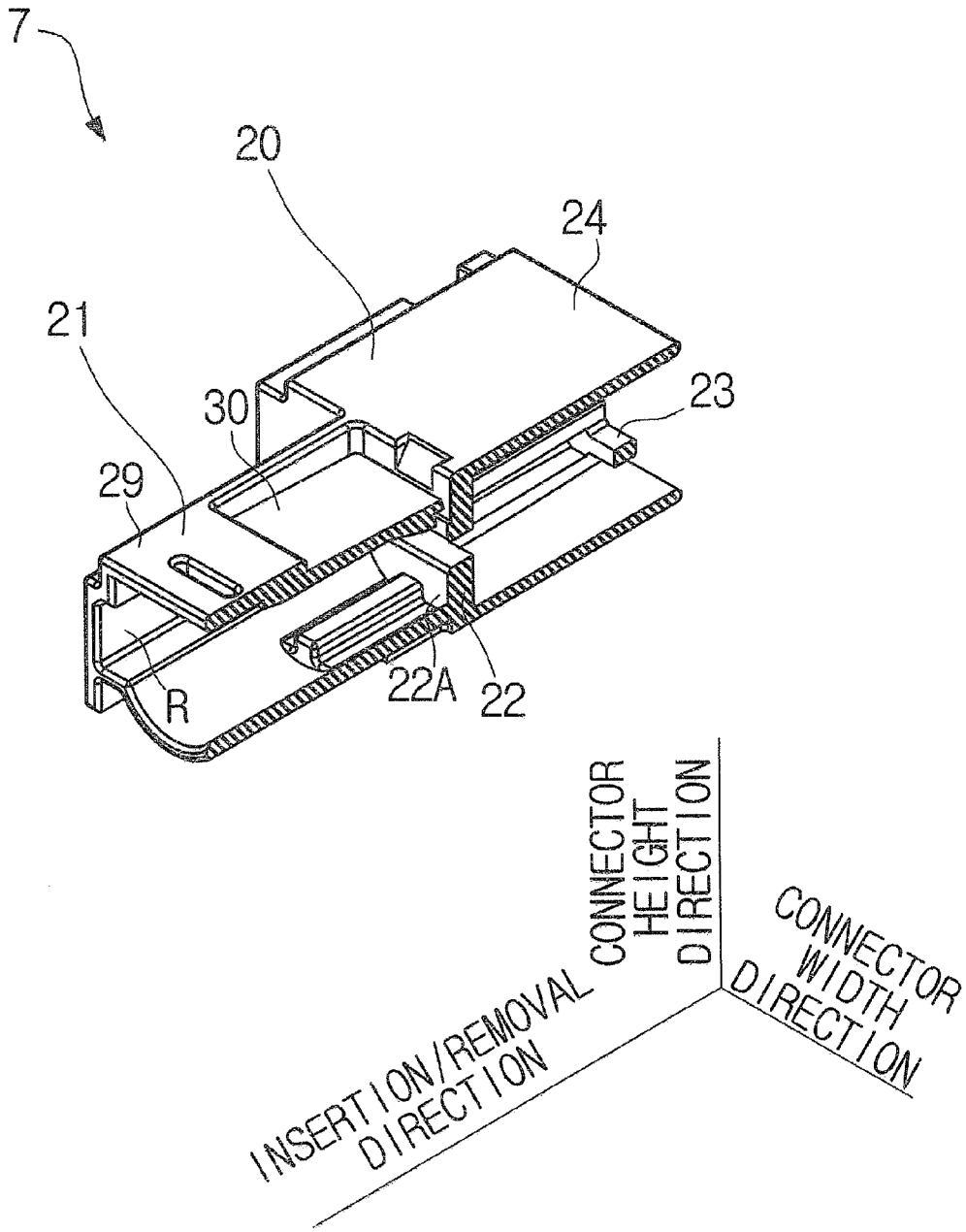
FIG. 7 is a partially cutaway perspective view of the plug housing (first embodiment)

FIGS. 6 to 10 each show the plug housing 7. As shown in FIGS. 6 and 7, the plug housing 7 includes a contact accommodating portion 20 and a crimping portion accommodating portion 21. The contact accommodating portion 20 is a portion that accommodates the plate-shaped contact portion 10 of the plug contact 6 shown in FIG. 3. The crimping portion accommodating portion 21 is a portion that accommodates the crimping portion 12 and the coupling portion 13 of the plug contact 6 shown in FIG. 3. The plug housing 7 is integrally formed with an insulating resin.

Figure 9:
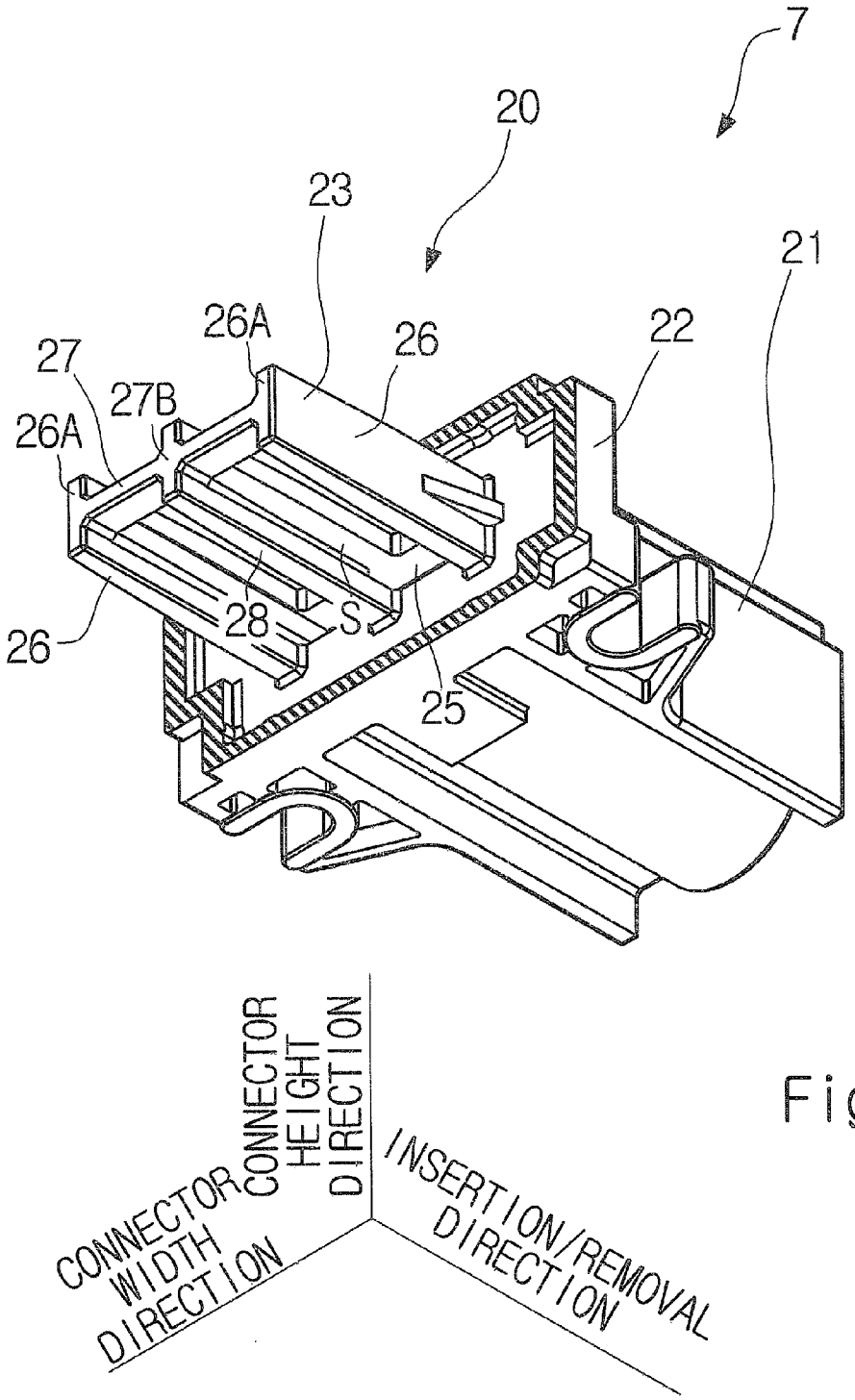
FIG. 9 is a partially cutaway perspective view of the plug housing (first embodiment)

As shown in FIG. 7, the contact accommodating portion 20 includes a base 22 (first housing body), an inside cover 23, and an outside cover 24. FIGS. 8 and 9 each show the plug housing 7 in which the illustration of the outside cover 24 is omitted for convenience of explanation.

As shown in FIG. 7, the base 22 is a plate body that is orthogonal to the mating direction. The base 22 has a base surface 22A facing in the removal direction. As shown in FIGS. 8 and 9, the base 22 has an insertion opening 25 into which the plate-shaped contact portion 10 of the plug contact 6 shown in FIG. 3 is inserted.

Figure 10:
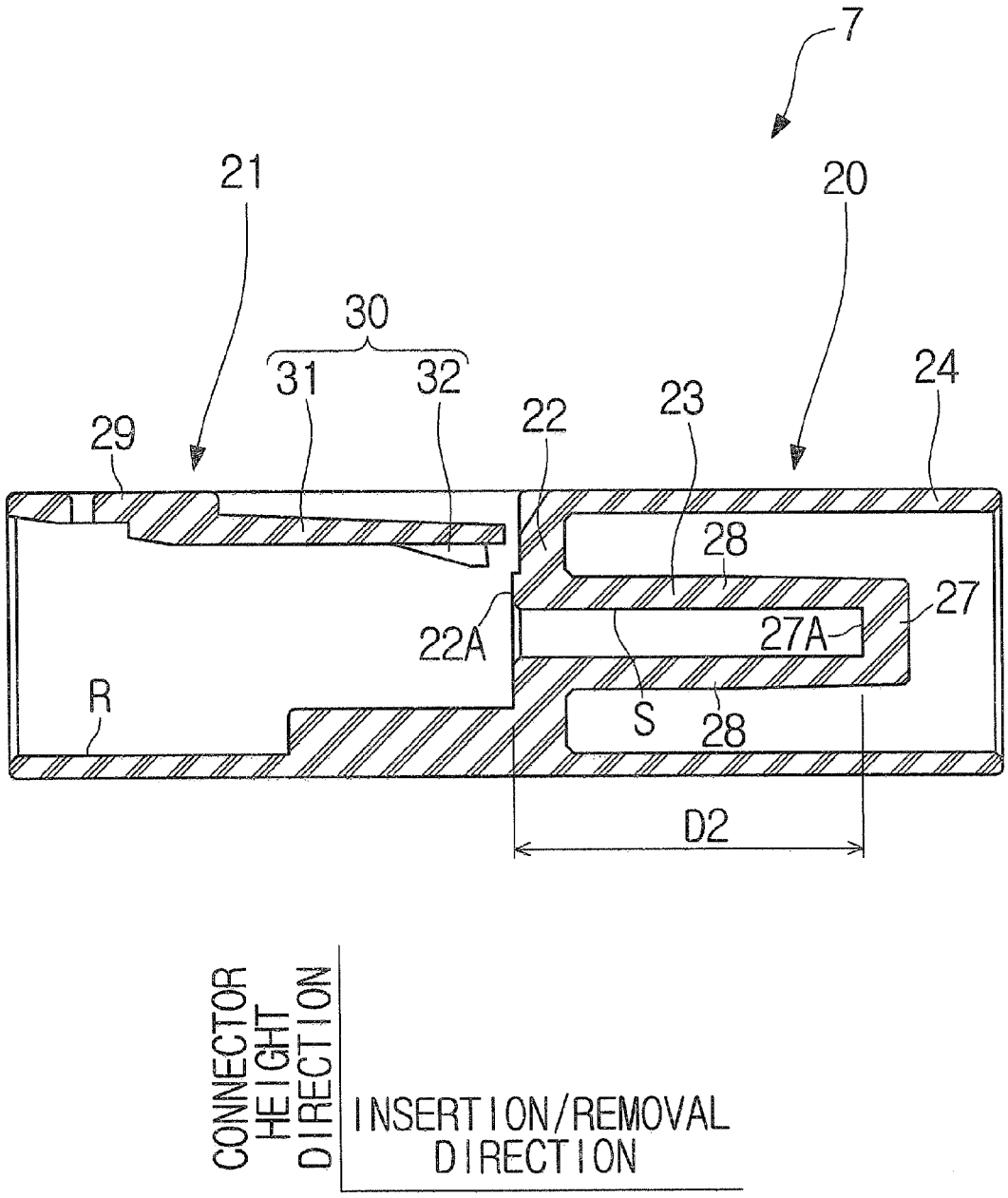
FIG. 10 is a sectional view of the plug housing (first embodiment)

The inside cover 23 shown in FIGS. 8 and 9 partially covers the plate-shaped contact portion 10 shown in FIG. 3, thereby preventing the plate-shaped contact portion 10 from being directly touched by an operator. As shown in FIGS. 8 and 9, the inside cover 23 has an insertion space S into which the plate-shaped contact portion 10 shown in FIG. 3 is inserted. The inside cover 23 includes a pair of side end cover portions 26, a leading end cover portion 27, and a pair of beams 28. The pair of side end cover portions 26 projects in the mating direction from the base 22 in such a manner that the side end cover portions 26 sandwich the insertion space S in the connector width direction, thereby covering the both side ends 10B of the plate-shaped contact portion 10 shown in FIG. 3. The leading end cover portion 27 couples leading ends 26A in the mating direction of the pair of side end cover portions 26, thereby covering the leading end 10A of the plate-shaped contact portion 10 shown in FIG. 3. FIG. 10 shows a section of the plug housing 7. As shown in FIG. 10, the leading end cover portion 27 includes a leading end cover surface 27A facing in the removal direction. As shown in FIGS. 8 to 10, the pair of beams 28 projects from the base 22 in the mating direction, thereby coupling the base 22 with a middle portion 27B in the longitudinal direction of the leading end cover portion 27. As shown in FIG. 10, the pair of beams 28 is disposed in such a manner that the beams 28 sandwich the insertion space S in the connector height direction. As shown in FIGS. 8 and 9, the pair of beams 28 extends in the insertion/removal direction. The middle portion 27B of the leading end cover portion 27 is located at the center of the leading end cover portion 27 in the longitudinal direction.

As shown in FIG. 7, the outside cover 24 is formed into a rectangular tubular shape projecting from the base 22 so as to cover the inside cover 23. The outside cover 24 projects further in the mating direction than does the leading end cover portion 27 of the inside cover 23. In other words, the outside cover 24 projects further in the mating direction beyond the leading end cover portion 27 of the inside cover 23.

As shown in FIG. 7, the crimping portion accommodating portion 21 is formed into a rectangular tubular shape projecting in the removal direction from the base 22 of the contact accommodating portion 20. The crimping portion accommodating portion 21 has an accommodation space R that accommodates the crimping portion 12 and the coupling portion 13 of the plug contact 6 shown in FIG. 3. As shown in FIGS. 6 and 7, the crimping portion accommodating portion 21 includes a top plate 29 that partitions the accommodation space R in the upward direction. The top plate 29 is provided with a lance 30. As shown in FIG. 10, the lance 30 includes a lance body 31 which is elastically deformable in the connector height direction, and a claw 32 which projects in the accommodation space R from the lance body 31.

As shown in FIG. 10, the distance between the base surface 22A of the base 22 and the leading end cover surface 27A of the leading end cover portion 27 in the insertion/removal direction is defined as a distance D2. The distance D2 is designed to be longer than the distance D1 shown in FIG. 5.

Figure 11:
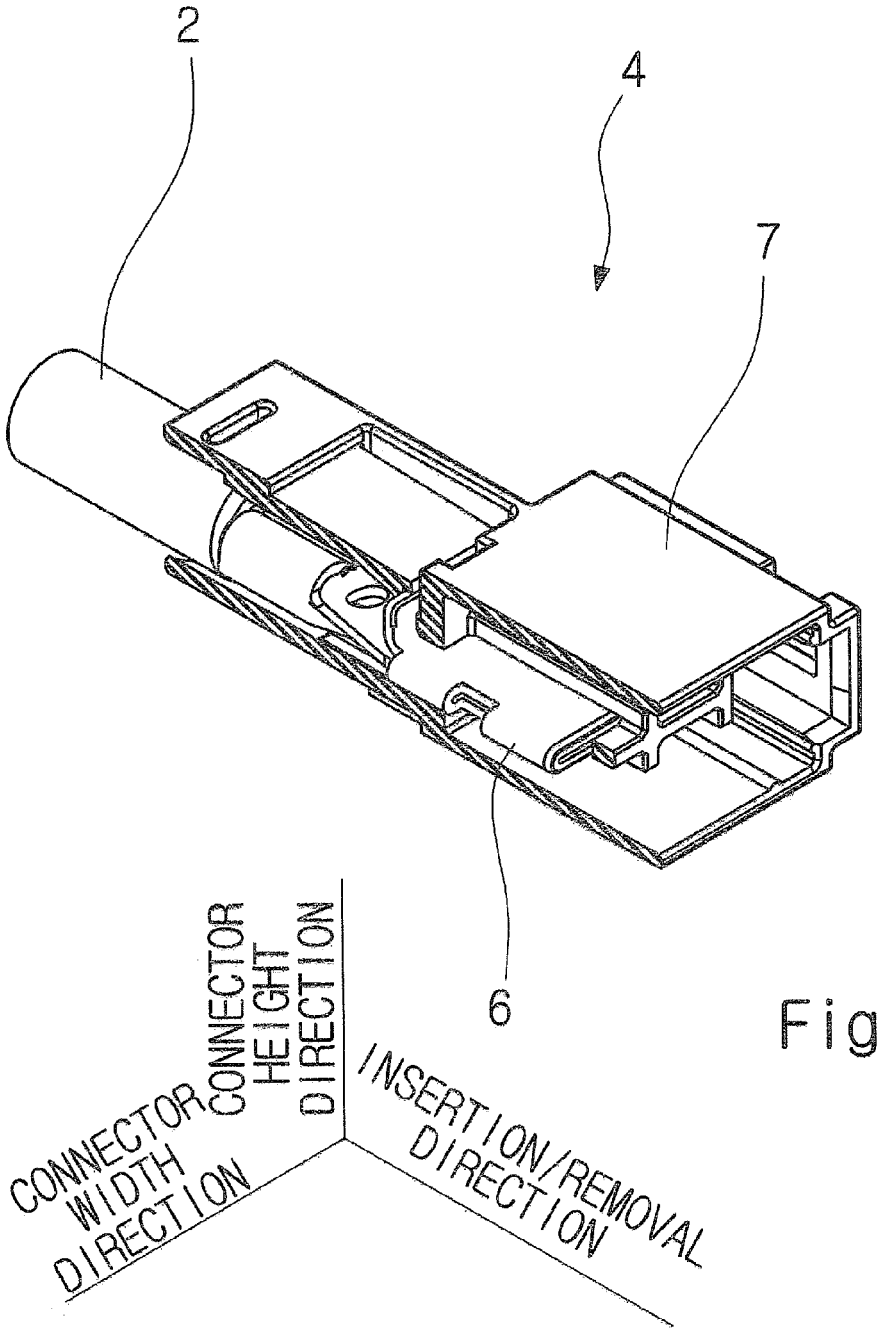
FIG. 11 is a partially cutaway perspective view of a plug connector (first embodiment)

FIG. 11 shows a state where the plug contact 6 which is attached to the plug-side wire 2 is accommodated in the plug housing 7. In order to accommodate the plug contact 6 in the plug housing 7 in this manner, the plate-shaped contact portion 10 of the plug contact 6 shown in FIG. 5 is inserted into the insertion space S of the inside cover 23 of the plug housing 7 shown in FIG. 10 in the mating direction. As a result, the movement regulating portion 11 shown in FIG. 5 passes over the claw 32 shown in FIG. 10, and the movement regulating portion 11 shown in FIG. 5 is sandwiched between the claw 32 and the base surface 22A of the base 22 shown in FIG. 10 in the insertion/removal direction. In this state, when the plug contact 6 moves in the mating direction relative to the plug housing 7 and the movement regulating portion 11 shown in FIG. 5 contacts the base surface 22A of the base 22 shown in FIG. 10, a further movement of the plug contact 6 in the mating direction relative to the plug housing 7 is inhibited. In this case, since the distance D1 shown in FIG. 5 and the distance D2 shown in FIG. 10 have the magnitude relationship as mentioned above, the leading end 10A of the plate-shaped contact portion 10 shown in FIG. 5 is prevented from contacting the leading end cover surface 27A of the leading end cover portion 27 shown in FIG. 10. On the other hand, when the plug contact 6 moves in the removal direction relative to the plug housing 7 and the movement regulating portion 11 shown in FIG. 5 contacts the claw 32 shown in FIG. 10, a further movement of the plug contact 6 in the removal direction relative to the plug housing 7 is inhibited.

Figure 12:
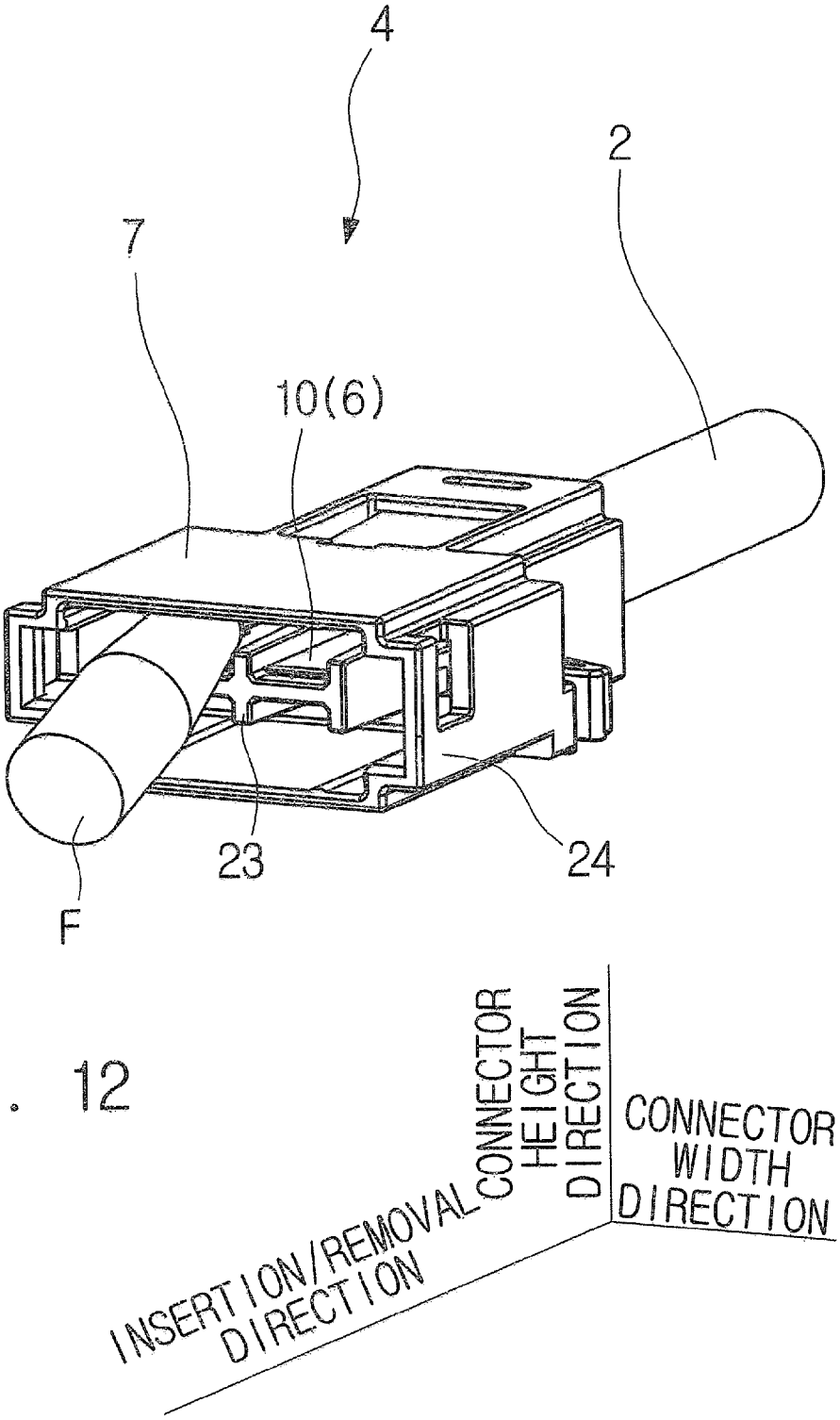
FIG. 12 is a perspective view showing a state where a finger is inserted into the plug connector (first embodiment)

FIG. 12 shows a state where a finger F is inserted into the outside cover 24 of the plug housing 7. As shown in FIG. 12, due to the presence of the inside cover 23 and the outside cover 24 of the plug housing 7, the operator cannot directly contact the plate-shaped contact portion 10 of the plug contact 6.

(Receptacle Connector 5)

FIGS. 13 to 16 each show the receptacle contact 8. As shown in FIGS. 13 to 16, the receptacle contact 8 includes a spring piece holding portion 40 having a rectangular tubular shape extending in the insertion/removal direction, a pair of upper elastic spring pieces 41 (first elastic spring pieces), a pair of lower elastic spring pieces 42 (second elastic spring pieces), an open-barrel-type crimping portion 43, and a coupling portion 44 that couples the spring piece holding portion 40 with the crimping portion 43. The receptacle contact 8 is integrally formed by bending a single metallic plate N.

As shown in FIGS. 13 to 16, the spring piece holding portion 40 includes a top plate 48 and a bottom plate 49, which are opposed to each other in the connector height direction, and a pair of side plates 50 which are opposed to each other in the connector width direction.

Figure 15:
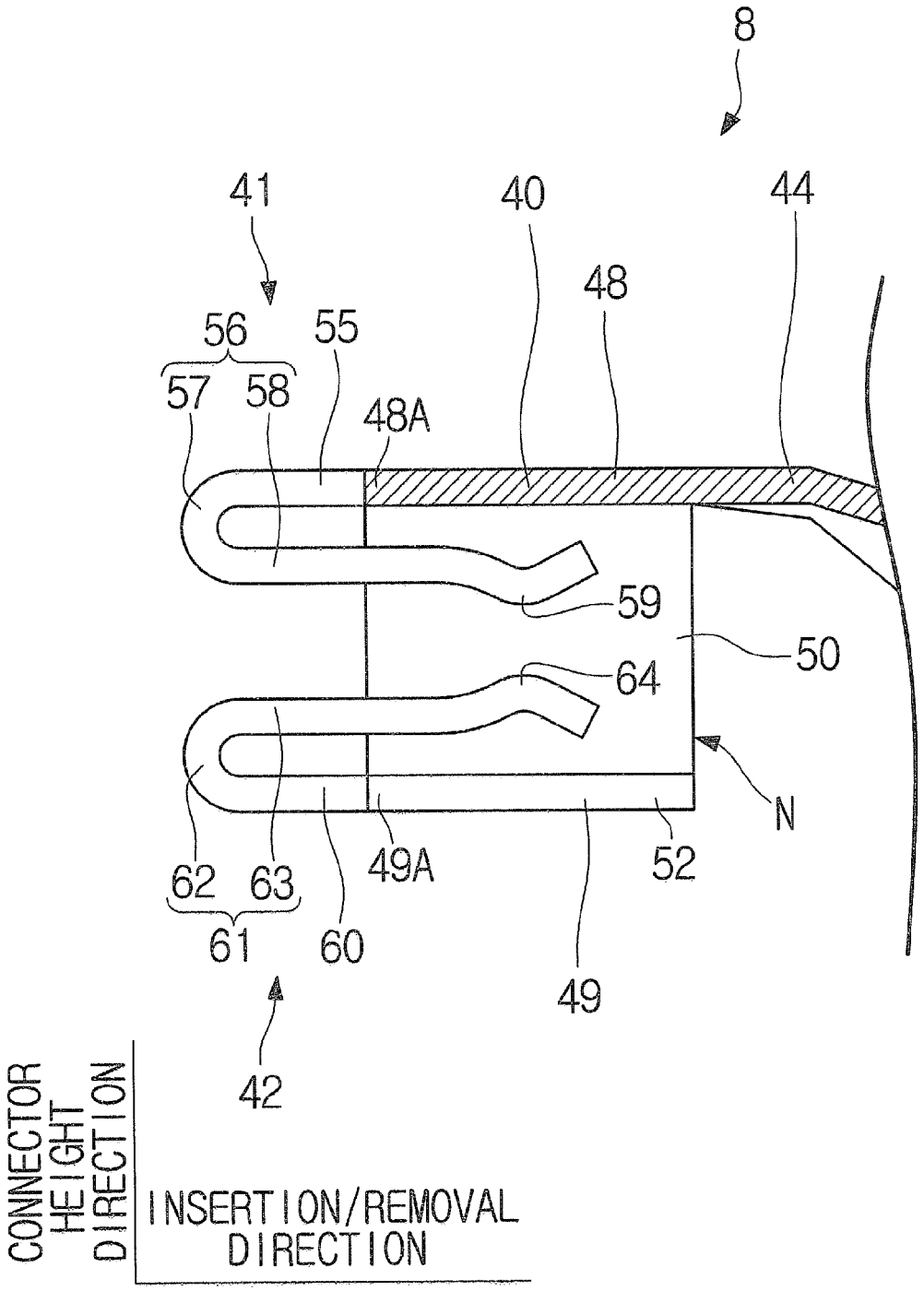
FIG. 15 is a sectional view of the receptacle contact (first embodiment)

As shown in FIG. 13, the top plate 48 has two lock holes 51. As shown in FIG. 15, the top plate 48 has a leading end 48A in the removal direction.

Figure 14:
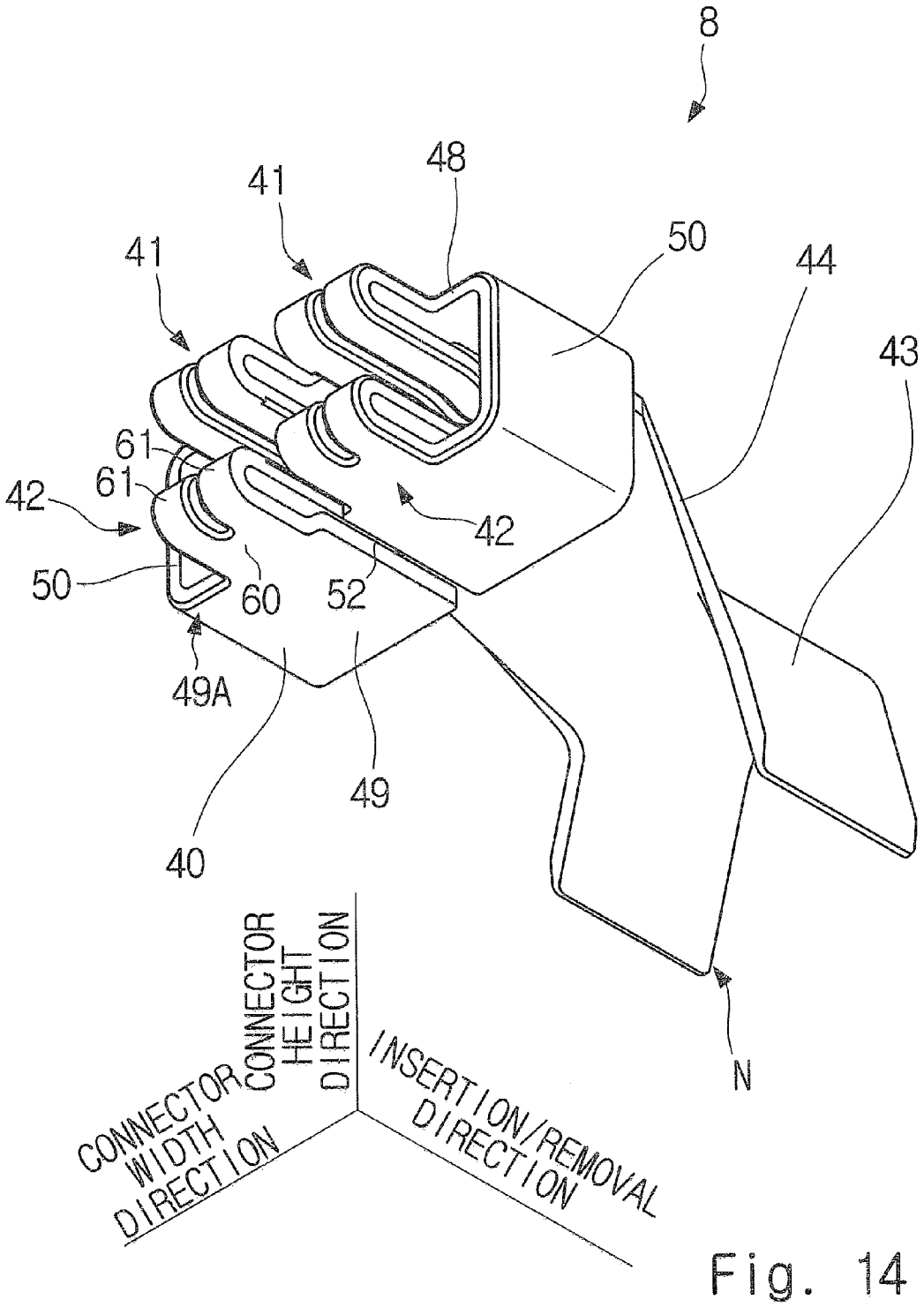
FIG. 14 is a perspective view of the receptacle contact as viewed from another angle (first embodiment)

As shown in FIG. 14, the bottom plate 49 includes a slit 52 which is formed as a result of bending a single metallic plate N to form the spring piece holding portion 40 into a rectangular tubular shape. As shown in FIG. 15, the bottom plate 49 has a leading end 49A in the removal direction.

As shown in FIG. 13, the pair of upper elastic spring pieces 41 is formed so as to project from the leading end 48A of the top plate 48. The upper elastic spring pieces 41 are a little apart from each other in the connector width direction. Each upper elastic spring piece 41 includes a proximal end portion 55 and a pair of elastic spring pieces 56. The proximal end portion 55 projects in the removal direction from the leading end 48A of the top plate 48. The pair of elastic spring pieces 56 is formed so as to project from the proximal end portion 55. The elastic spring pieces 56 are a little apart from each other in the connector width direction. As shown in FIG. 15, each elastic spring piece 56 includes a curved portion 57 and an easily deformable portion 58. The curved portion 57 projects in the downward direction from the proximal end portion 55 and is curved in a convex shape in the removal direction. The easily deformable portion 58 projects in the mating direction from the curved portion 57. The easily deformable portion 58 includes a contact portion 59 that swells out in the downward direction. The contact portion 59 is located inside of the spring piece holding portion 40.

As shown in FIG. 14, the pair of lower elastic spring pieces 42 is formed so as to project from the leading end 49A of the bottom plate 49. The lower elastic spring pieces 42 are a little apart from each other in the connector width direction. Each lower elastic spring piece 42 includes a proximal end portion 60 and a pair of elastic spring pieces 61. The proximal end portion 60 projects in the removal direction from the leading end 49A of the bottom plate 49. The pair of elastic spring pieces 61 is formed so as to project from the proximal end portion 60. The elastic spring pieces 61 are a little apart from each other in the connector width direction. As shown in FIG. 15, each elastic spring piece 61 includes a curved portion 62 and an easily deformable portion 63. The curved portion 62 projects in the upward direction from the proximal end portion 60 and is curved in a convex shape in the removal direction. The easily deformable portion 63 projects in the mating direction from the curved portion 62. The easily deformable portion 63 includes a contact portion 64 that swells out in the upward direction. The contact portion 64 is located inside of the spring piece holding portion 40.

Figure 16:
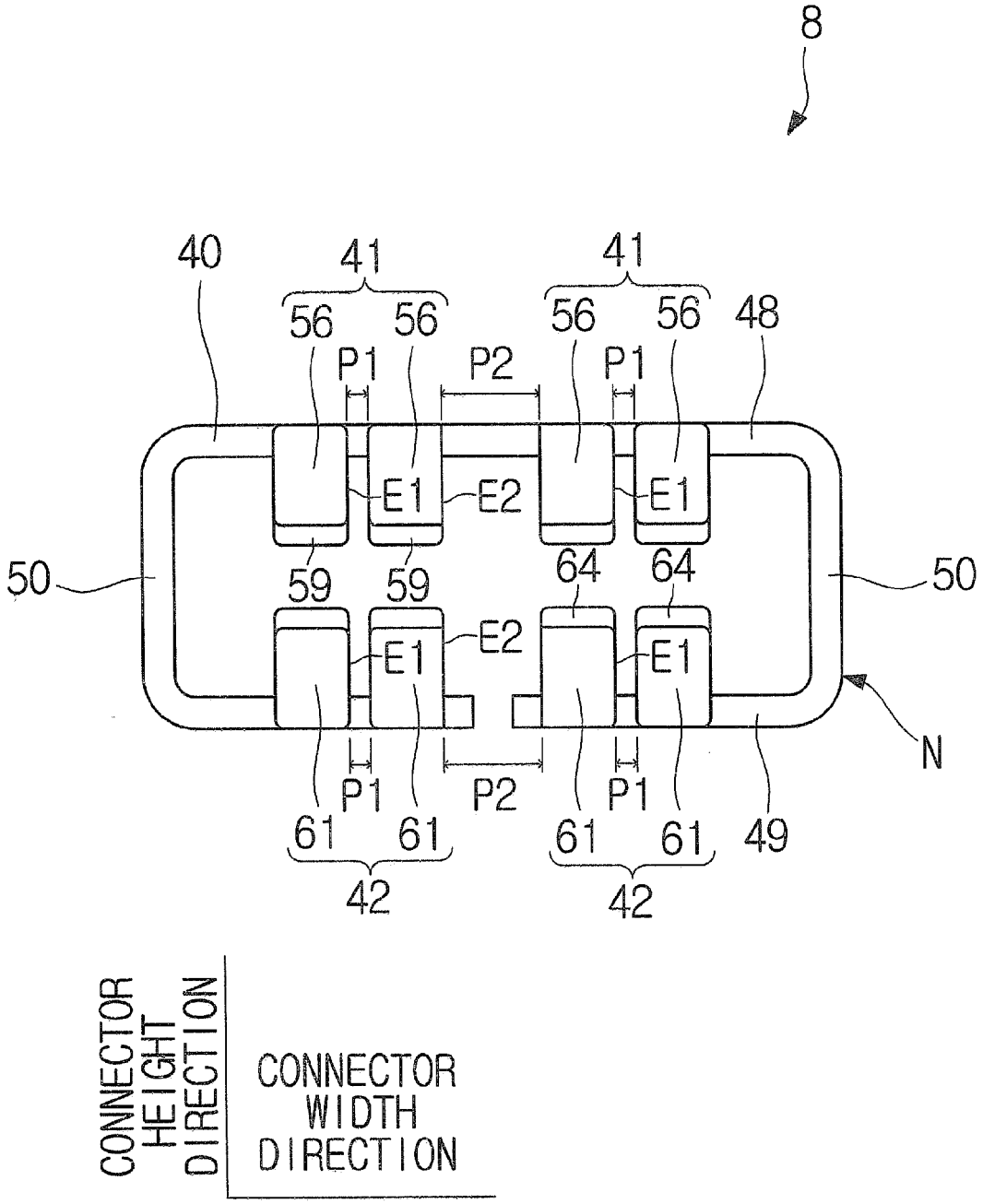
FIG. 16 is a front view of the receptacle contact (first embodiment)

Accordingly, when the receptacle contact 8 is viewed from the front side, as shown in FIG. 16, it is seen that the receptacle contact 8 includes four elastic spring pieces 56 and four elastic spring pieces 61. In other words, the receptacle contact 8 includes four contact portions 59 and four contact portions 64.

As shown in FIGS. 13 to 16, the pair of upper elastic spring pieces 41 is opposed to the pair of lower elastic spring pieces 42 in the connector height direction. Specifically, as shown in FIGS. 13 to 16, the pair of elastic spring pieces 56 of each upper elastic spring piece 41 is opposed to the pair of elastic spring pieces 61 of the corresponding lower elastic spring piece 42 in the connector height direction. Furthermore, as shown in FIGS. 15 and 16, the contact portion 59 of each elastic spring piece 56 is opposed to the contact portion 64 of the corresponding elastic spring piece 61 in the connector height direction.

Specific dimensions of the receptacle contact 8 will now be described. As shown in FIG. 16, the receptacle contact 8 includes four elastic spring pieces 56 which are arranged in a comb pattern in the connector width direction. The pitch between the four elastic spring pieces 56 in the connector width direction is not constant. The dimension in the connector width direction of a gap E1 between the two elastic spring pieces 56, which belong to one upper elastic spring piece 41, is defined as a width dimension P1. The dimension in the connector width direction of a gap E2 in the connector width direction between the pair of upper elastic spring pieces 41 is defined as a width dimension P2. Specifically, the width dimension P2 is equal to the spaced distance in the connector width direction between the elastic spring pieces 56 which is one of the two elastic spring pieces 56 belonging to one of the upper elastic spring pieces 41, the elastic spring pieces 56 being closer to the other one of the upper elastic spring pieces 41, and the elastic spring pieces 56 which is one of the two elastic spring pieces 56 belonging to the other one of the upper elastic spring pieces 41, the elastic spring pieces 56 being closer to the one of the upper elastic spring pieces 41. The width dimension P1 and the width dimension P2 have a relation of P2>P1.

The same holds true for the four elastic spring pieces 61 which are arranged in a comb pattern in the connector width direction. Specifically, the pitch between the four elastic spring pieces 61 in the connector width direction is not constant. The dimension in the connector width direction of the gap E1 between the two elastic spring pieces 61, which belong to one lower elastic spring piece 42, is equal to the width dimension P1. The dimension in the connector width direction of the gap E2 between the pair of lower elastic spring pieces 42 is equal to the width dimension P2.

Figure 17:
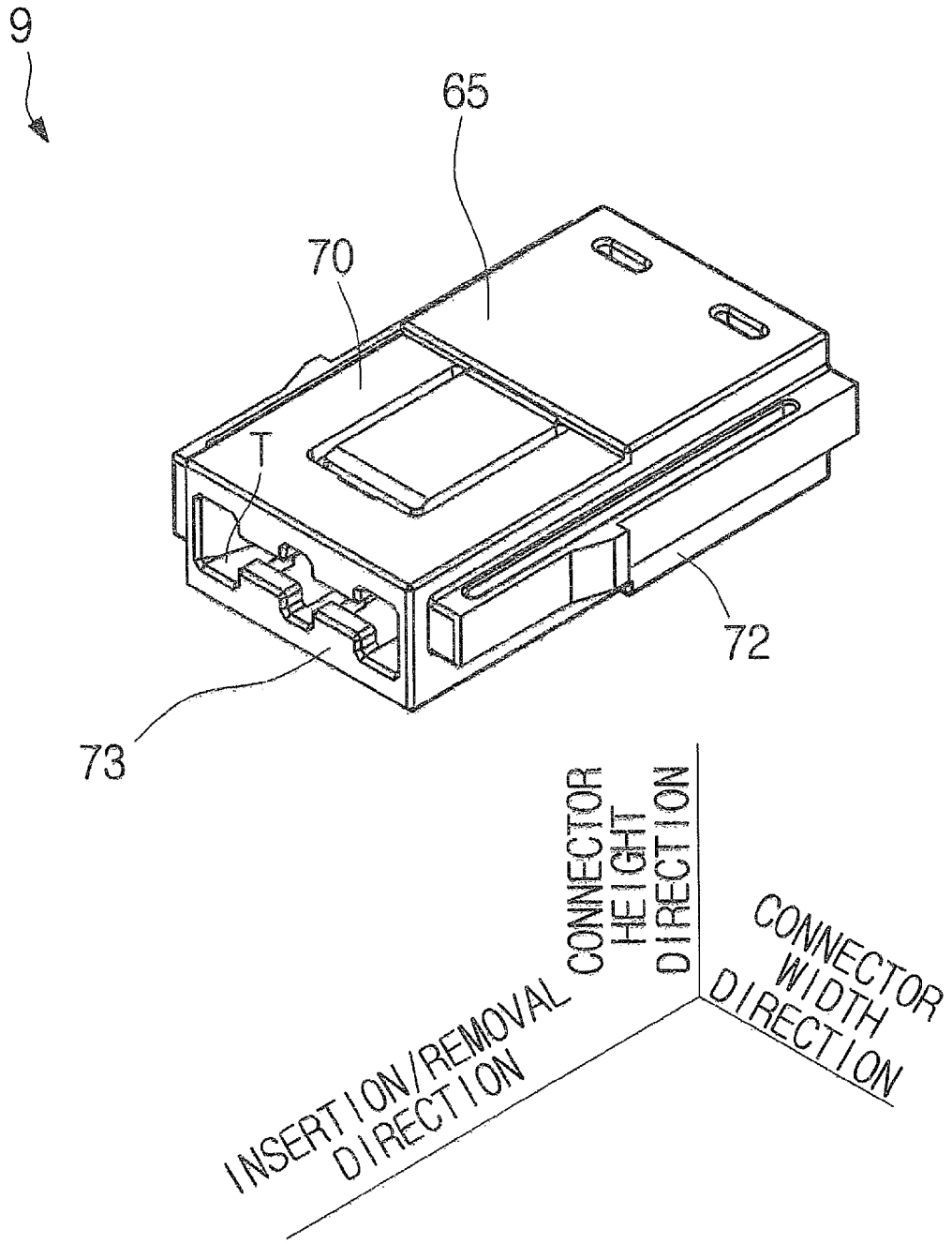
FIG. 17 is a perspective view of a receptacle housing (first embodiment)
Figure 18:
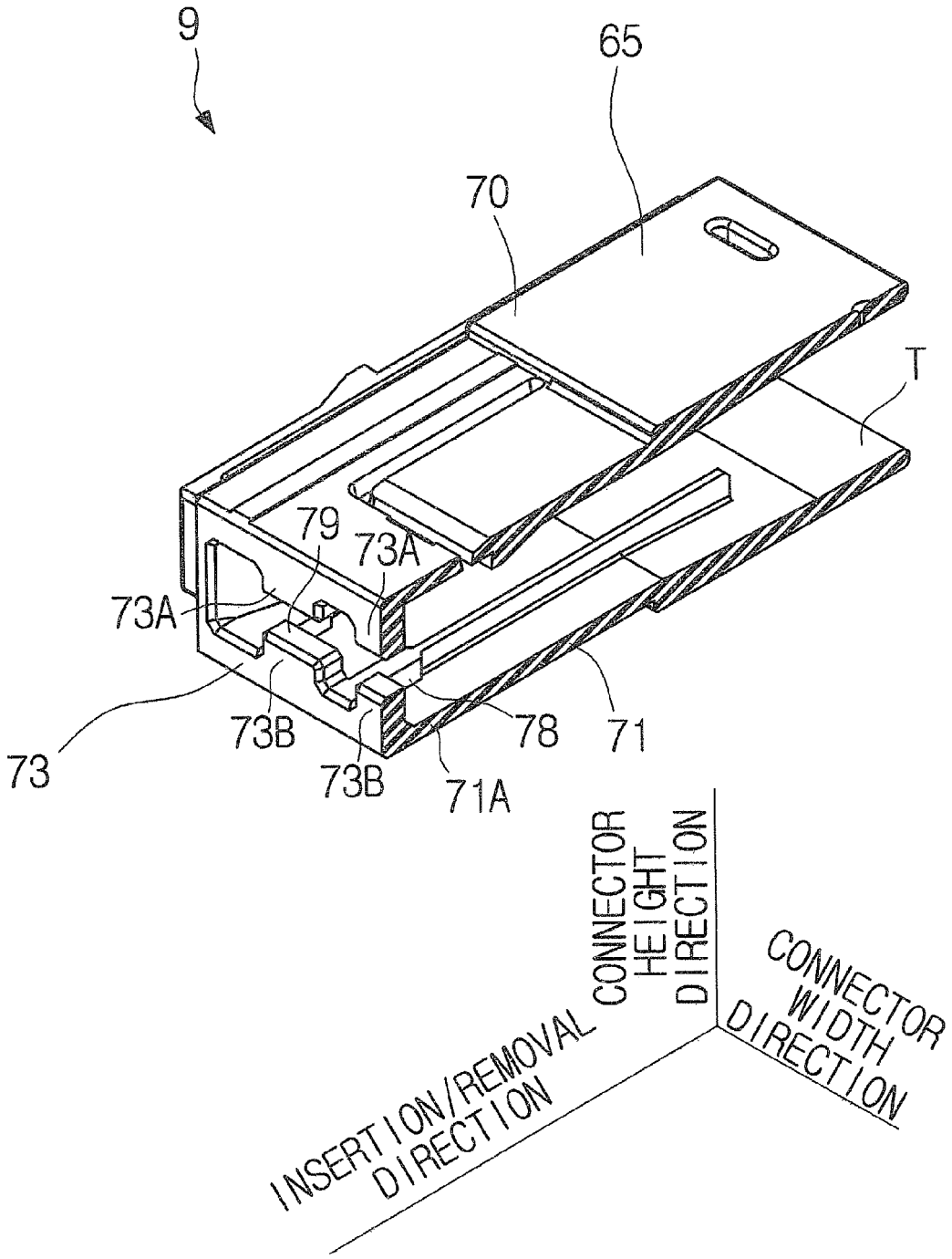
FIG. 18 is a partially cutaway perspective view of the receptacle housing (first embodiment)
Figure 19:
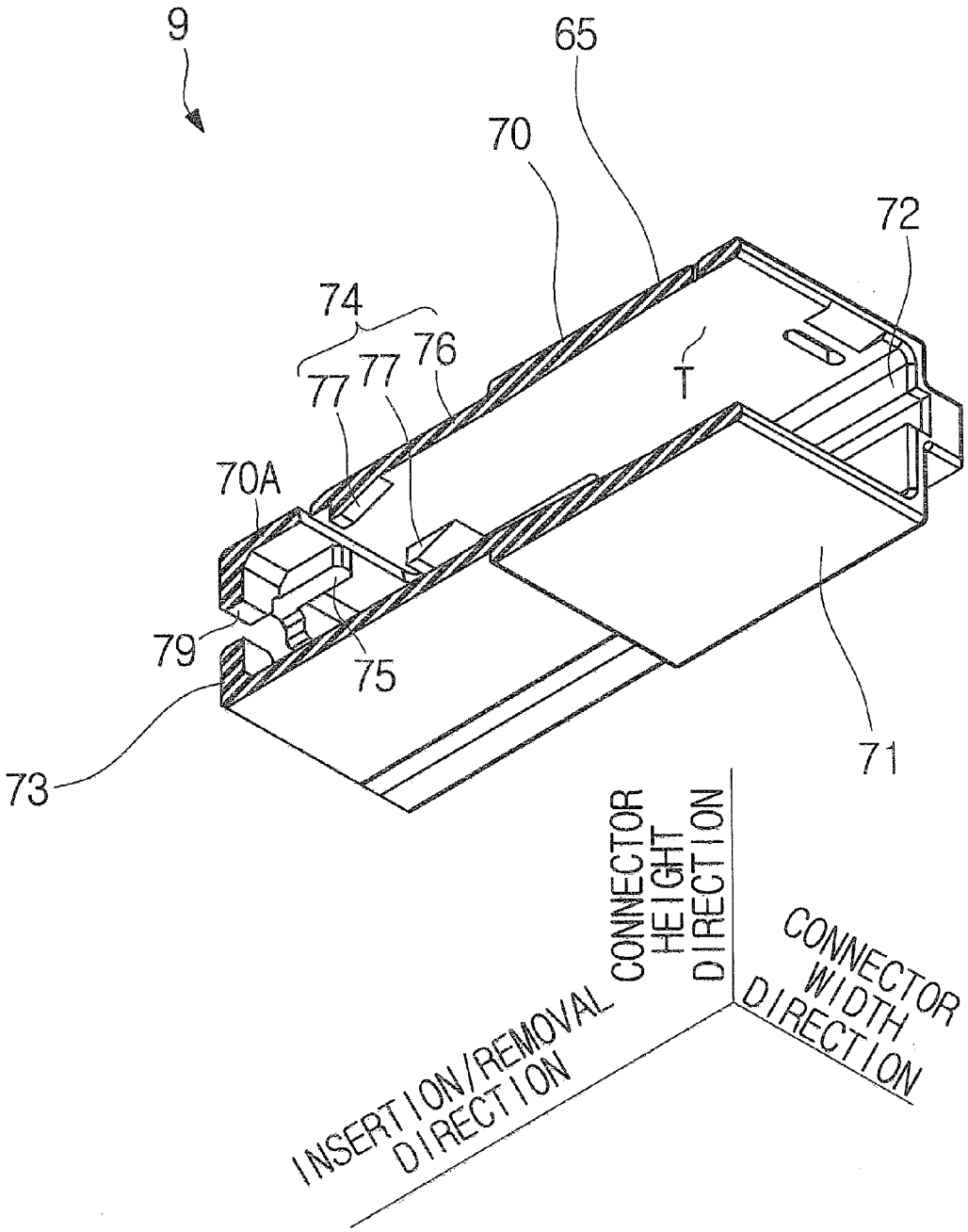
FIG. 19 is a partially cutaway perspective view of the receptacle housing as viewed from another angle (first embodiment)

FIGS. 17 to 19 each show the receptacle housing 9. As shown in FIGS. 17 to 19, the receptacle housing 9 includes a cylinder portion 65, which has a rectangular tubular shape and extends in the insertion/removal direction, and a lid portion 73. The receptacle housing 9 is integrally formed with an insulating resin. The cylinder portion 65 includes an accommodation space T in which the receptacle contact 8 is accommodated. The cylinder portion 65 includes a top plate 70, which partitions the accommodation space T in the upward direction, a bottom plate 71, which partitions the accommodation space T in the downward direction, and a pair of side plates 72 which partitions the accommodation space T in the connector width direction. The lid portion 73 partitions the accommodation space T in the removal direction.

As shown in FIG. 19, the top plate 70 has a leading end 70A in the removal direction. The top plate 70 is provided with a lance 74 and a top plate key 75. The lance 74 includes a lance body 76, which is elastically deformable in the connector height direction, and a pair of claws 77 which projects toward the accommodation space T from the lance body 76. The top plate key 75 projects toward the accommodation space T from the leading end 70A of the top plate 70.

As shown in FIG. 18, the bottom plate 71 has a leading end 71A in the removal direction. The bottom plate 71 is provided with a bottom plate key 78. The bottom plate key 78 projects toward the accommodation space T from the leading end 71A of the bottom plate 71.

As shown in FIG. 18, the lid portion 73 has an opening 79 for inserting the plate-shaped contact portion 10 and the inside cover 23 of the plug connector 4 shown in FIG. 1 into the accommodation space T of the receptacle housing 9. The opening 79 is formed to have a minimum size required for insertion of the inside cover 23. Further, as shown in FIG. 18, the lid portion 73 includes a pair of upper spring piece cover portions 73A which is opposed to the pair of upper elastic spring pieces 41 of the receptacle contact 8 shown in FIG. 13 in the insertion/removal direction. Similarly, the lid portion 73 includes a pair of lower spring piece cover portions 73B which is opposed to the pair of lower elastic spring pieces 42 of the receptacle contact 8 shown in FIG. 13 in the insertion/removal direction.

FIG. 20 shows a state where the receptacle contact 8 which is attached to the receptacle-side wire 3 is accommodated in the receptacle housing 9. In order to accommodate the receptacle contact 8 in the receptacle housing 9 in this manner, the receptacle contact 8 shown in FIG. 13 is inserted into the accommodation space T of the receptacle housing 9 shown in FIG. 18 in the removal direction. When the receptacle contact 8 shown in FIG. 13 is inserted to a predetermined position in the accommodation space T shown in FIG. 18, the claws 77 of the lance 74 shown in FIG. 19 move into the lock holes 51 of the receptacle contact 8 shown in FIG. 13, respectively, thereby inhibiting the receptacle contact 8 from being removed from the receptacle housing 9 in the mating direction.

In this state, the top plate key 75 of the receptacle housing 9 shown in FIG. 19 is inserted into the gap E2 between the pair of upper elastic spring pieces 41 of the receptacle contact 8 shown in FIG. 16. Similarly, the bottom plate key 78 of the receptacle housing 9 shown in FIG. 18 is inserted into the gap E2 between the pair of lower elastic spring pieces 42 of the receptacle contact 8 shown in FIG. 16. The top plate key 75 and the bottom plate key 78 are inserted into the receptacle contact 8 in this manner, thereby positioning the receptacle contact 8 with respect to the receptacle housing 9 in the connector width direction.

Figure 21:
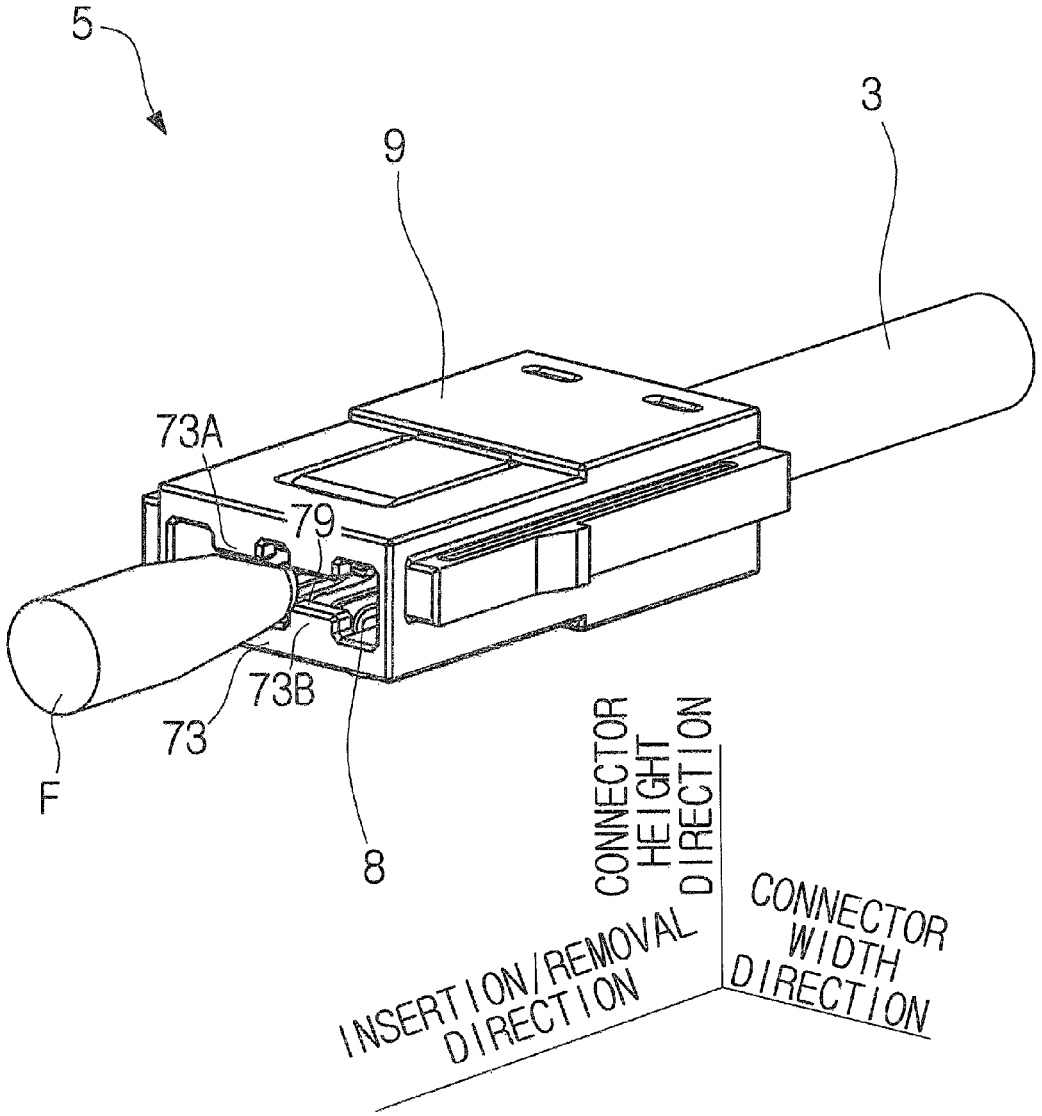
FIG. 21 is a perspective view showing a state where a finger is inserted into the receptacle connector (first embodiment)

FIG. 21 shows a state where the finger F is inserted into the opening 79 of the lid portion 73. As shown in FIG. 21, due to the presence of the pair of upper spring piece cover portions 73A and the pair of lower spring piece cover portions 73B of the lid portion 73, the operator cannot directly contact the receptacle contact 8.

(Mating of the Connector Assembly 1)

Next, mating of the connector assembly 1 will be described.

As shown in FIG. 1, the plug housing 7 is provided with a pair of plug-side mating lock claws 80. Similarly, the receptacle housing 9 is provided with a pair of receptacle-side mating lock claws 81.

FIGS. 1 and 2 show a state where the plug connector 4 is mated to the receptacle connector 5. In order to mate the plug connector 4 to the receptacle connector 5, the plate-shaped contact portion 10 of the plug connector 4 shown in FIG. 1 is inserted into the opening 79 of the lid portion 73 of the receptacle connector 5, and the plug-side mating lock claws 80 engage with the receptacle-side mating lock claws 81, respectively. As a result, the plug-side wire 2 and the receptacle-side wire 3 are electrically connected to each other.

Specifically, the plate-shaped contact portion 10 of the plug contact 6 shown in FIG. 3 is inserted between the pair of upper elastic spring pieces 41 and the pair of lower elastic spring pieces 42 of the receptacle contact 8 shown in FIG. 13. As a result, the contact portions 59 of the four elastic spring pieces 56 of the receptacle contact 8 shown in FIG. 15 are brought into contact with the upper contact surface 10D of the plate-shaped contact portion 10 shown in FIG. 3 by an elastic restoring force. Similarly, the contact portions 64 of the four elastic spring pieces 61 of the receptacle contact 8 shown in FIG. 15 are brought into contact with the lower contact surface 10E of the plate-shaped contact portion 10 shown in FIG. 4 by an elastic restoring force. Thus, the plug contact 6 shown in FIG. 3 and the receptacle contact 8 shown in FIG. 15 contact each other at eight contact points.

Figure 22:
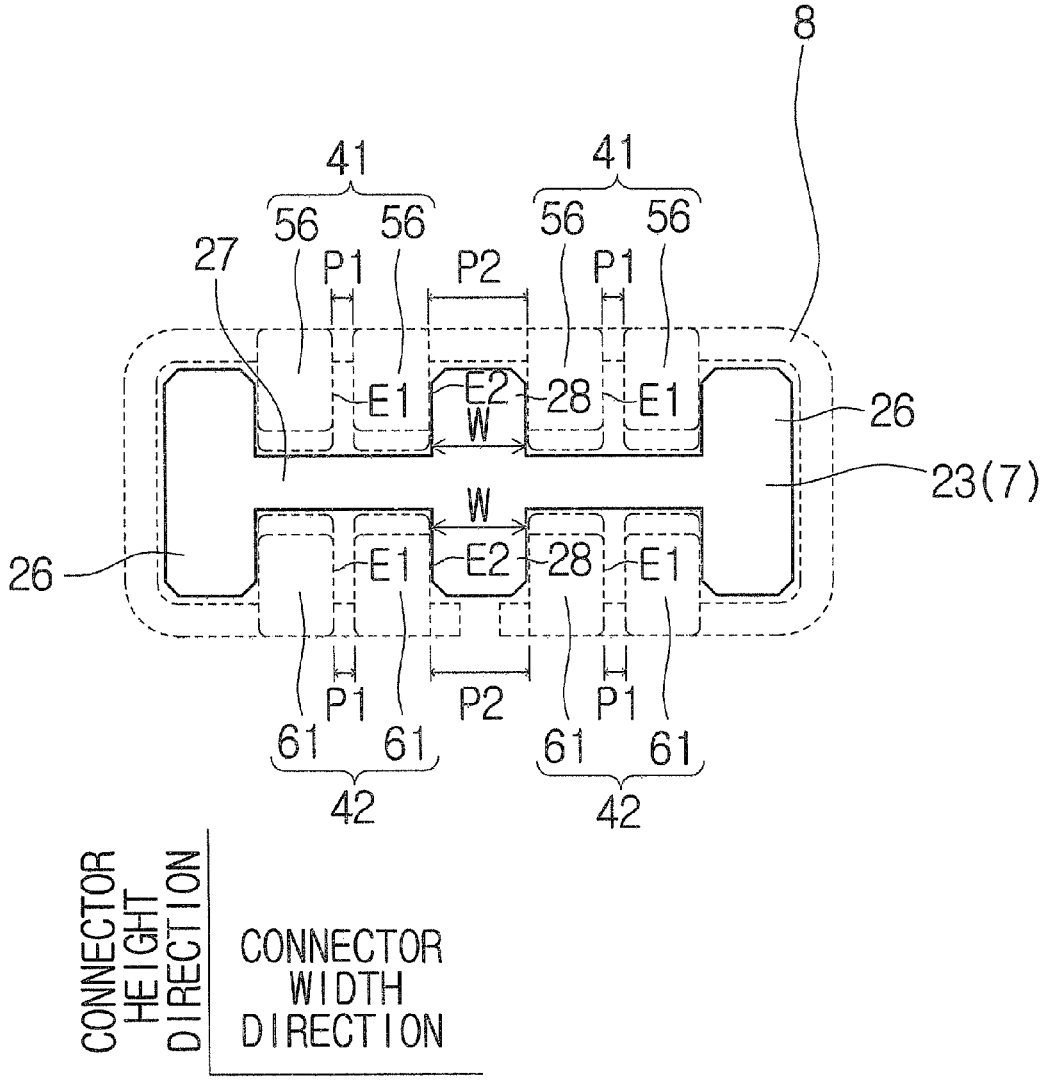
FIG. 22 is a front view showing a relationship between the plug housing and the receptacle contact after mating of the plug connector to the receptacle connector (first embodiment)

FIG. 22 shows a positional relationship between the receptacle contact 8 and the inside cover 23 as viewed in the mating direction when the plug connector 4 is mated to the receptacle connector 5. As shown in FIG. 22, one of the pair of beams 28 is inserted into the gap E2 between the pair of upper elastic spring pieces 41, and is not inserted into the gap E1 between the pair of elastic spring pieces 56 belonging to one of the upper elastic spring pieces 41. Assuming that the dimension in the connector width direction of each beam 28 is defined as a width dimension W, the relationship of P2>W>P1 is established. The width dimension P1 of the gap E1 in which the beam 28 is not inserted is actively reduced in this manner, thereby achieving miniaturization of the receptacle contact 8 in the connector width direction, in comparison with a case where the four elastic spring pieces 56 are arranged at regular intervals in the connector width direction. The number of elastic spring pieces 56 is not reduced to achieve the miniaturization of the receptacle contact 8 in the connector width direction. Consequently, it is possible to ensure a large number of contact points, while achieving the miniaturization of the receptacle contact.

Figure 23:
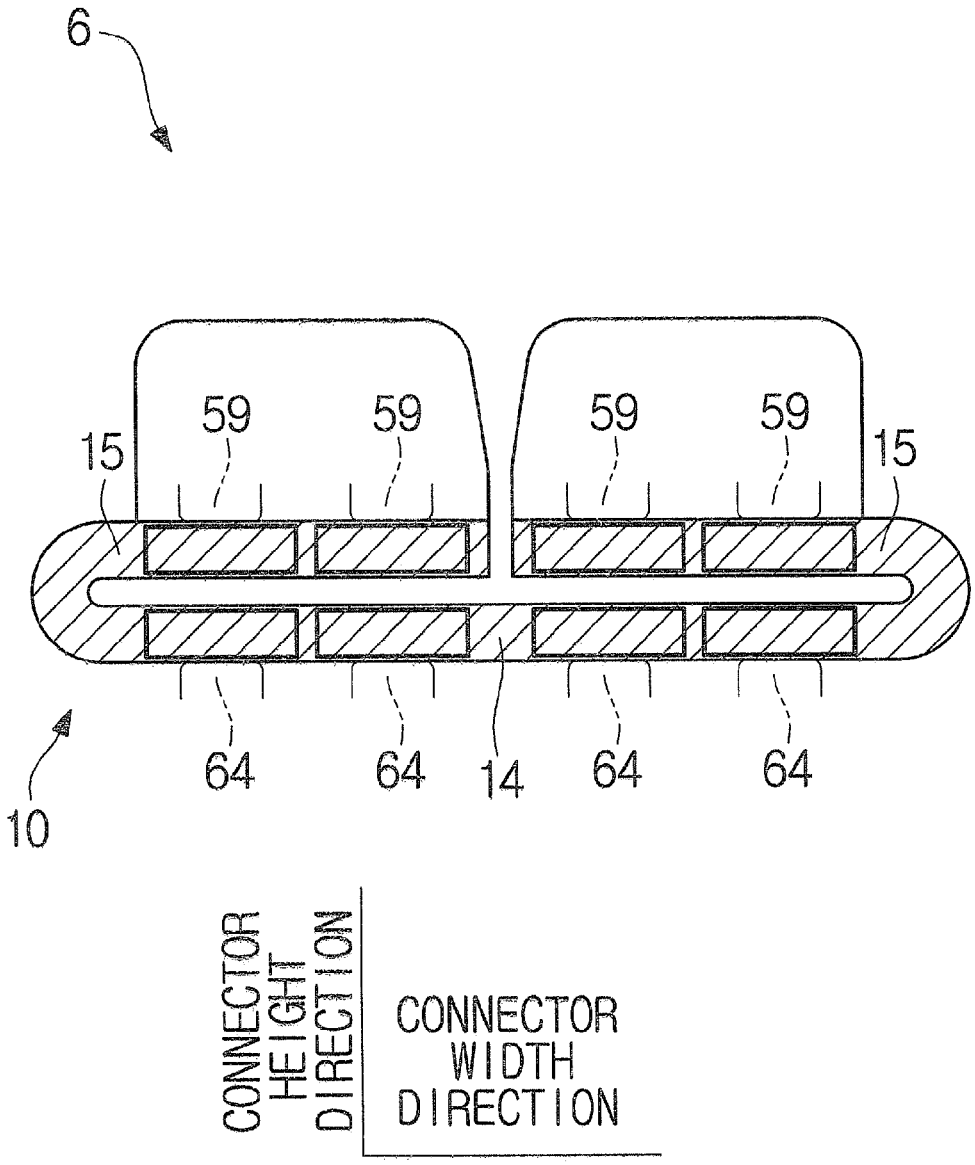
FIG. 23 is a sectional view taken along a line XXIII-XXIII shown in FIG. 5 (first embodiment)

FIG. 23 shows a section specified in FIG. 5. Since the plate-shaped contact portion 10 of the plug contact 6 is formed by folding the metallic plate M back as shown in FIG. 23, the plate-shaped contact portion 10 of the plug contact 6 has a thickness that is twice the thickness of the metallic plate M. Thus, an effectively large section of the plate-shaped contact portion 10 in the vicinity of the contact portions 59 and the contact portions 64 can be ensured, in comparison with a case where the plate-shaped contact portion 10 is formed of a single metallic plate M without folding the metallic plate M back. Consequently, a maximum current allowed at each contact point between the plate-shaped contact portion 10 and the contact portions 59 and contact portions 64 can be set to be large.

The first embodiment of the present invention described above has the following features.

(1) The connector assembly 1 includes: the plug connector 4 (first connector) including the plug housing 7 (first housing) and the plug contact 6 (first contact) held in the plug housing 7; and the receptacle connector 5 (second connector) including the receptacle housing 9 (second housing) and the receptacle contact 8 (second contact) held in the receptacle housing 9. The plug connector 4 is mated to the receptacle connector 5, to thereby electrically connect the plug contact 6 to the receptacle contact 8. The plug contact 6 includes the plate-shaped contact portion 10 (plate-shaped contact portion) which is parallel to the mating direction. The plate-shaped contact portion 10 includes the upper contact surface 10D (first contact surface) where the receptacle contact 8 is contactable. The plug housing 7 includes: the base 22 (first housing body); the pair of side end cover portions 26 that projects in the mating direction from the base 22 and covers the both side ends 10B of the plate-shaped contact portion 10; the leading end cover portion 27 that couples the leading ends 26A of the pair of side end cover portions 26 in the mating direction and covers the leading end 10A of the plate-shaped contact portion 10; the pair of beams 28 that couples the base 22 with the middle portion 27B of the leading end cover portion 27 in the longitudinal direction; and the outside cover 24 (housing cover portion) that covers the receptacle housing 9 in the state where the plug connector 4 is mated to the receptacle connector 5. The receptacle contact 8 includes the pair of upper elastic spring pieces 41 (first elastic spring pieces) which is contactable with the upper contact surface 10D and is disposed in such a manner that the upper elastic spring pieces 41 sandwich one of the beams 28 in the state where the plug connector 4 is mated to the receptacle connector 5. The receptacle contact 8 is formed by bending a single metallic plate M. According to the above structure, a high connection reliability as well as a reduction in the number of components can be achieved.

(2) The plate-shaped contact portion 10 includes the lower contact surface 10E (second contact surface) which is a surface opposite to the upper contact surface 10D. The receptacle contact 8 includes the pair of lower elastic spring pieces 42 (second elastic spring pieces) which is contactable with the lower contact surface 10E. The pair of upper elastic spring pieces 41 and the pair of lower elastic spring pieces 42 are opposed to each other in a state before the plug connector 4 is mated to the receptacle connector 5. According to the above structure, the number of contact points can be effectively increased.

(3) The plate-shaped contact portion 10 is formed by folding the metallic plate M back. Specifically, the magnitude of the maximum current allowed at each contact point between the plug connector 4 and the receptacle connector 5 increases as the sectional area of the plate-shaped contact portion 10 at each contact point increases as shown in FIG.

23. According to the above structure, since the thickness of the plate-shaped contact portion 10 is substantially increased, a large maximum current allowed at each contact point can be ensured.

If the plate-shaped contact portion 10 is formed of a single thick plate so as to ensure that the plate-shaped contact portion 10 has a large sectional area, it is necessary to increase the thickness of the metallic plate M itself, which results in an increase in the thickness of the crimping portion 12. This is disadvantageous in the operation in which the crimping portion 12 crimps the plug-side wire 2. Accordingly, if the plate-shaped contact portion 10 is formed of a single thick plate so as to ensure that the plate-shaped contact portion 10 has a large sectional area, it is necessary to prepare the plate-shaped contact portion 10 and the crimping portion 12 as separate components and to couple the plate-shaped contact portion 10 with the crimping portion 12, which leads to an increase in the cost of the plug connector 4. On the other hand, when the plate-shaped contact portion 10 is formed by folding the metallic plate M back as described above, the plate-shaped contact portion 10 and the crimping portion 12 can be integrally formed as a single component, while ensuring that the plate-shaped contact portion 10 has a large sectional area, which contributes to a reduction in the cost of the plug connector 4.

(4, 5) As shown in FIG. 3, in the plate-shaped contact portion 10, the fold 16 which is formed by folding the metallic plate M is parallel to the mating direction. Alternatively, the fold 16 may be orthogonal to the mating direction.

(6) The plug contact 6 further includes the movement regulating portion 11 that projects in the thickness direction of the plate-shaped contact portion 10. When the plug contact 6 moves in the mating direction relative to the plug housing 7 and the movement regulating portion 11 contacts the plug housing 7, the movement regulating portion 11 inhibits a further movement of the plug contact 6 in the mating direction relative to the plug housing 7, and when the plug contact 6 moves in the removal direction relative to the plug housing 7 and the movement regulating portion 11 contacts the plug housing 7, the movement regulating portion 11 inhibits a further movement of the plug contact 6 in the removal direction relative to the plug housing 7. According to the above structure, the plug contact 6 is inhibited from moving in the insertion/removal direction relative to the plug housing 7 when the plug connector 4 is mated to the receptacle connector 5 and when the plug connector 4 is removed from the receptacle connector 5.

If the plate-shaped contact portion 10 is formed of a single thick plate so as to ensure that the plate-shaped contact portion 10 has a large sectional area, it is necessary to increase the thickness of the metallic plate M itself, which makes it extremely difficult to bend the metallic plate M during the formation of the movement regulating portion 11. On the other hand, as shown in FIGS. 3 and 4, the plate-shaped contact portion 10 is formed with a large thickness by overlapping the lower contact portion 14 with the pair of upper contact portions 15 which is opposed to the lower contact portion 14 in the connector height direction. The lower contact portion 14 and the pair of upper contact portions 15 are formed by bending a single metallic plate M. The movement regulating portion 11 is formed of the pair of regulation pieces 17. The regulation pieces 17 are formed so as to project in the connector height direction from the upper contact portions 15, respectively, by bending the metallic plate M. According to the above structure, it is possible to easily bend the metallic plate M to form the movement regulating portion 11, while ensuring that the plate-shaped contact portion 10 has a large sectional area, which contributes to a reduction in the cost of the plug connector 4.

(7) Due to a friction between the plug contact 6 and the receptacle contact 8 when the plug connector 4 is removed from the receptacle connector 5, the plug contact 6 is pulled in the mating direction relative to the plug housing 7. When the plug contact 6 is pulled in the mating direction relative to the plug housing 7, the plate-shaped contact portion 10 of the plug contact 6 contacts the leading end cover portion 27, so that an external force in the mating direction acts on the leading end cover portion 27. As a result, the leading end cover portion 27 may be damaged. On the other hand, according to the above embodiment, the distance D2 (see FIG. 10) from the movement regulating portion 11 to the leading end cover portion 27 when the plug contact 6 moves in the mating direction relative to the plug housing 7 and the movement regulating portion 11 contacts the plug housing 7 is larger than the distance D1 (see FIG. 5) from the movement regulating portion 11 to the leading end 10A of the plate-shaped contact portion 10. According to the above structure, when the plug connector 4 is removed from the receptacle connector 5, the plate-shaped contact portion 10 of the plug contact 6 does not contact the leading end cover portion 27, so that the external force in the mating direction does not act on the leading end cover portion 27 and thus the leading end cover portion 27 is less likely to be damaged.

(8) For example, as shown in FIG. 13, each upper elastic spring piece 41 includes two elastic spring pieces 56 which are contactable with the upper contact surface 10D of the plate-shaped contact portion 10. According to the above structure, the number of contact points can be more effectively increased. Similarly, for example, as shown in FIG. 14, each lower elastic spring piece 42 includes two elastic spring pieces 61 which are contactable with the lower contact surface 10E of the plate-shaped contact portion 10. According to the above structure, the number of contact points can be more effectively increased.

(9) For example, as shown in FIG. 18, the receptacle housing 9 includes the cylinder portion 65 including: the accommodation space T that extends in the mating direction and accommodates the receptacle contact 8; and the lid portion 73 that partitions the accommodation space T in the removal direction. The lid portion 73 has the opening 79 for inserting the plate-shaped contact portion 10 of the plug contact 6, the pair of side end cover portions 26, the leading end cover portion 27, and the pair of beams 28 into the accommodation space T. The lid portion 73 includes the pair of upper spring piece cover portions 73A (first elastic spring piece cover portions) that is opposed to the pair of upper elastic spring pieces 41 shown in FIG. 13 in the insertion/removal direction. According to the above structure, the opening 79 of the lid portion 73 has a minimum size required for mating, which makes it difficult to directly contact the receptacle contact 8, and thus is useful to prevent electric shock.

(Second Embodiment)

Figure 24:
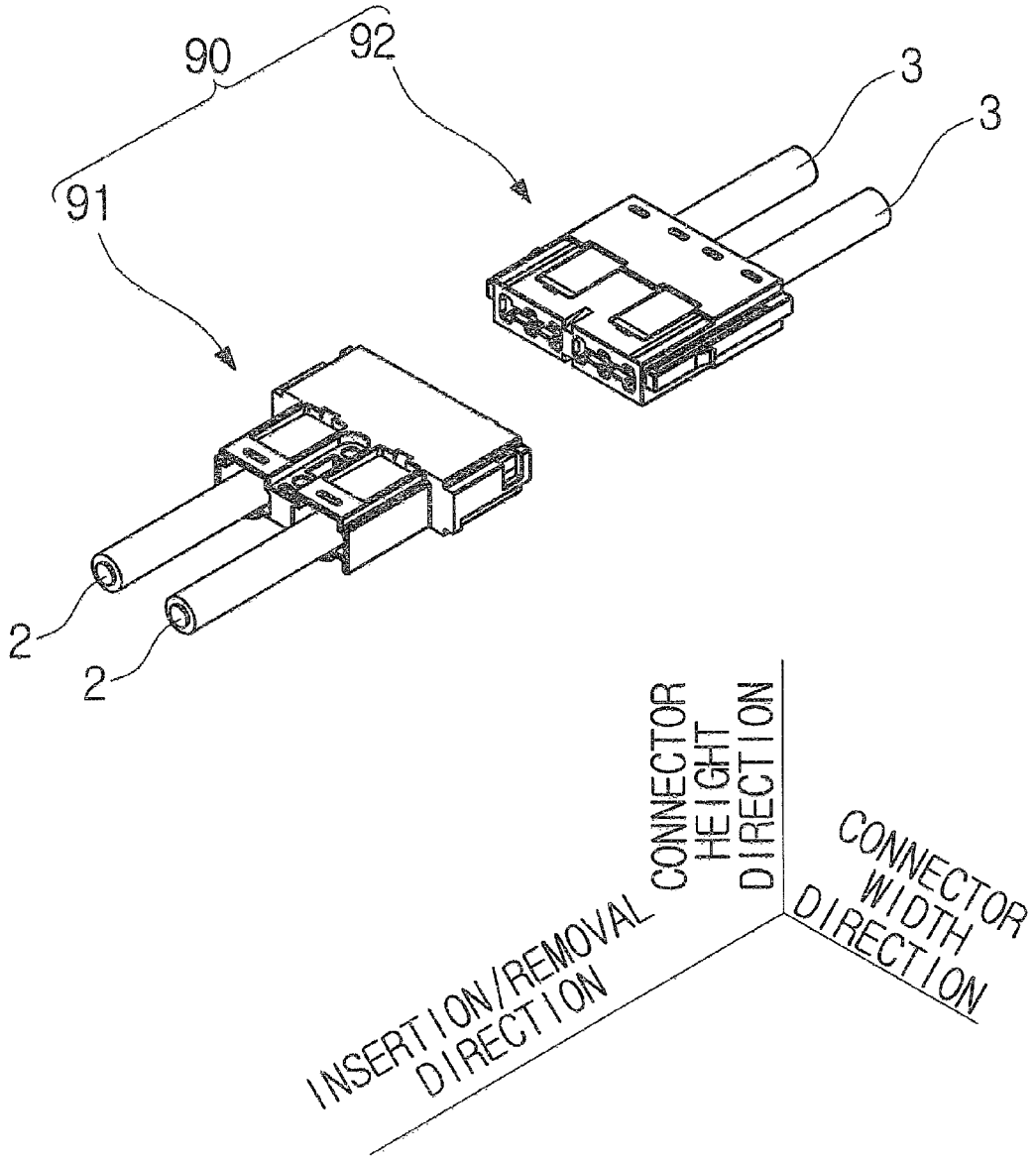
FIG. 24 is a perspective view of a connector assembly before mating (second embodiment)

Referring next to FIG. 24, a second embodiment will be described. A connector assembly 90 according to the second embodiment includes a plug connector 91 to be attached to two plug-side wires 2, and a receptacle connector 92 to be attached to two receptacle-side wires 3. The plug connector 91 has a structure in which two plug connectors 4 according to the first embodiment are integrally arranged in a row in the connector width direction. The receptacle connector 92 has a structure in which two receptacle connectors 5 according to the first embodiment are integrally arranged in a row in the connector width direction.

(Third Embodiment)

Figure 25:
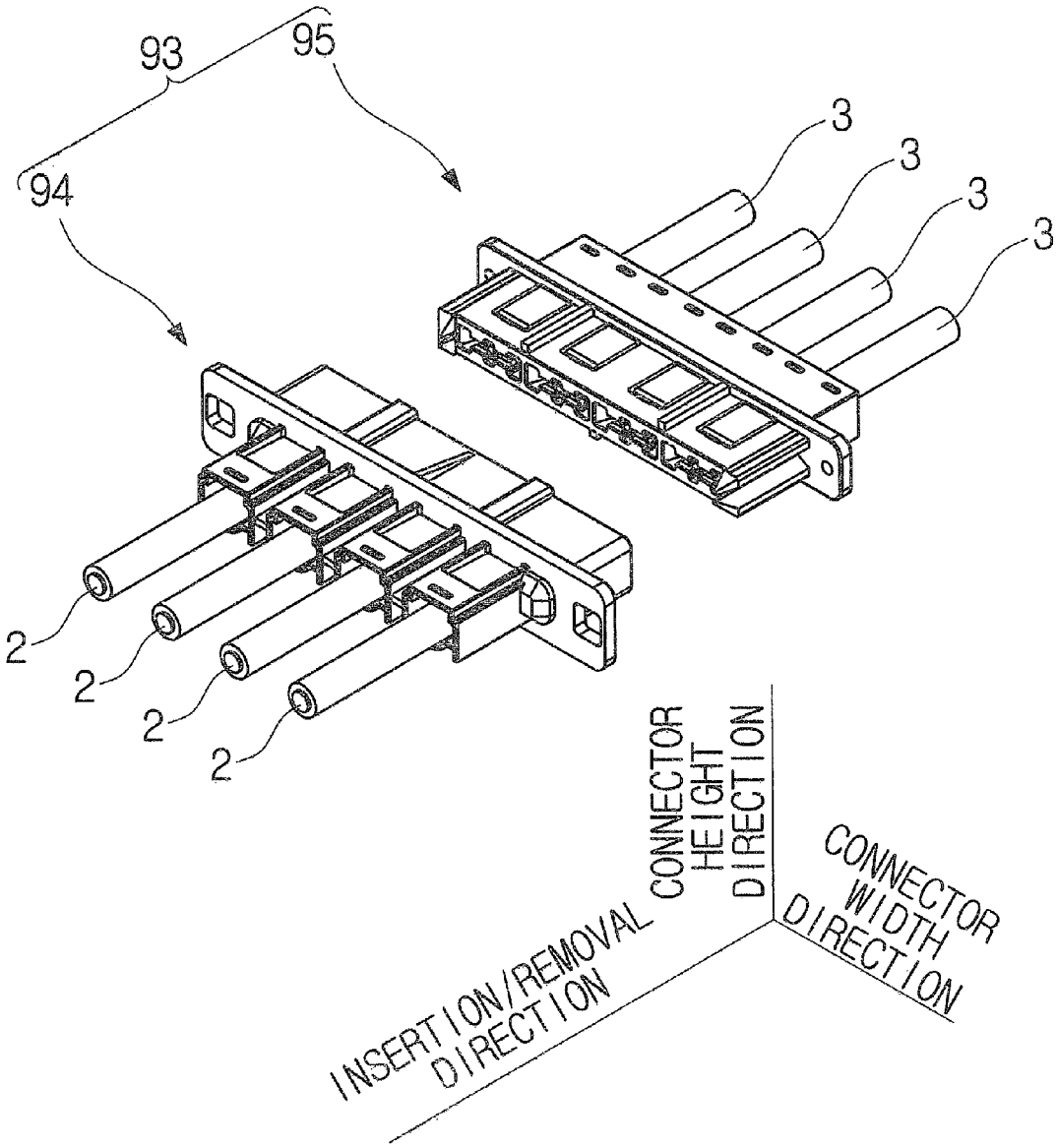
FIG. 25 is a perspective view of a connector assembly before mating (third embodiment)
Figure 26:
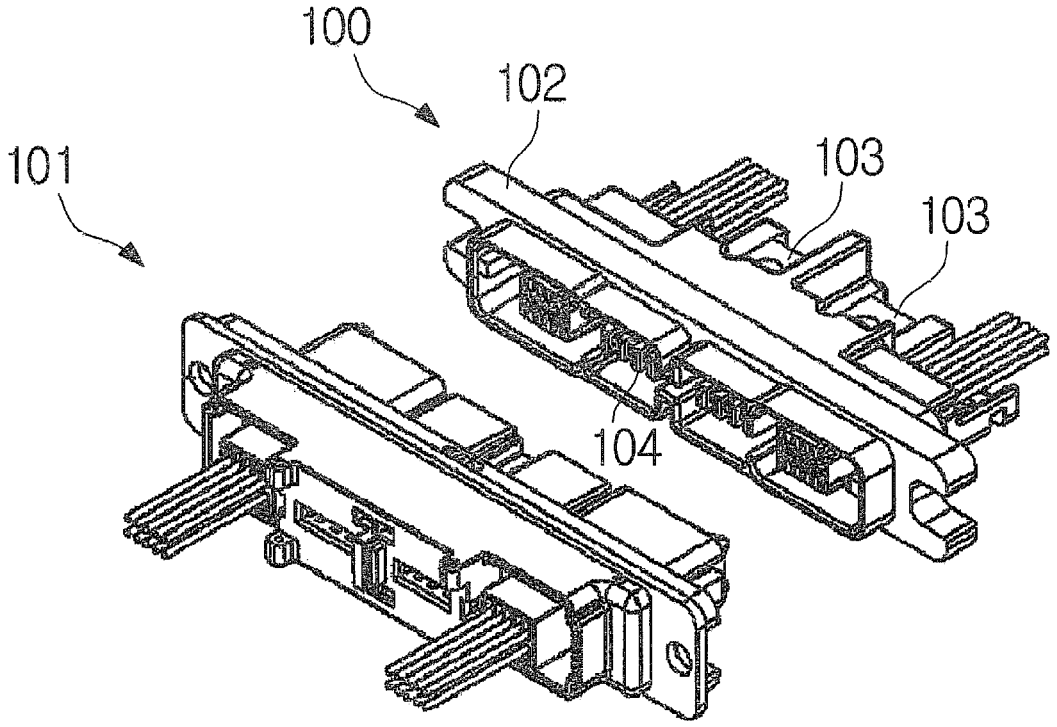
FIG. 26 is a view corresponding to FIG. 5 of Patent Literature 1.
Figure 27:
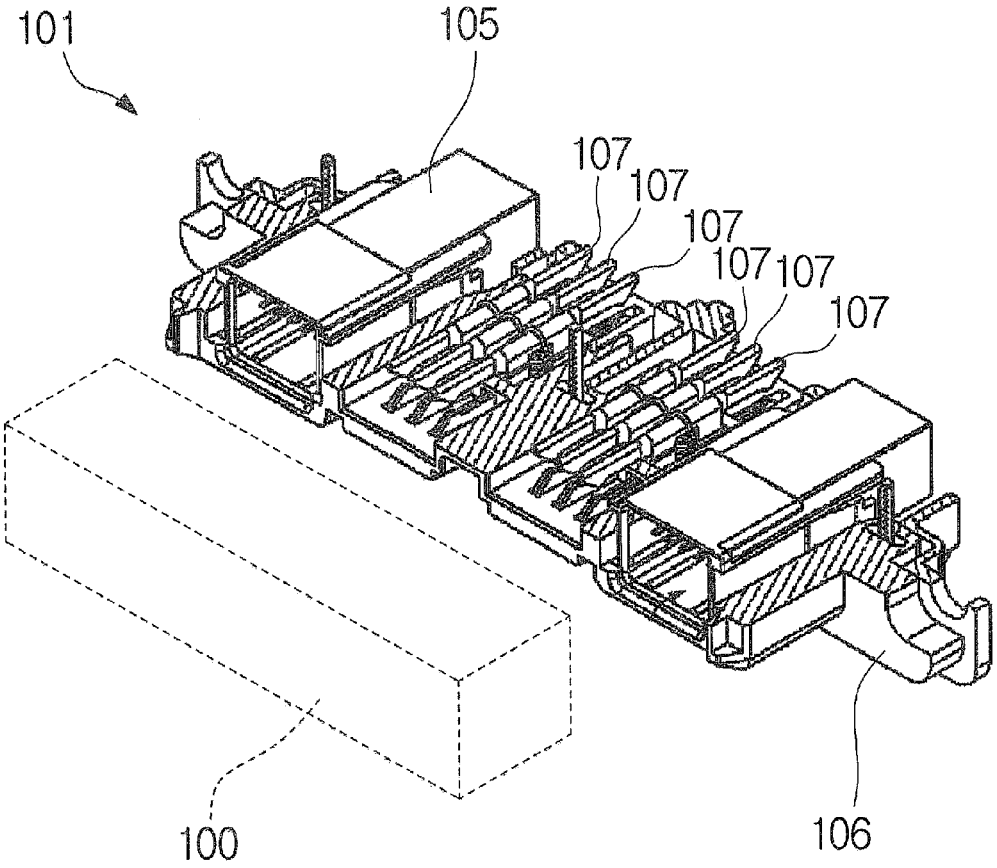
FIG. 27 is a view corresponding to FIG. 12 of Patent Literature 1.

Referring next to FIG. 25, a third embodiment will be described. A connector assembly 93 according to the third embodiment includes a plug connector 94 to be attached to four plug-side wires 2, and a receptacle connector 95 to be attached to four receptacle-side wires 3. The plug connector 94 has a structure in which four plug connectors 4 according to the first embodiment are integrally arranged in a row in the connector width direction. The receptacle connector 95 has a structure in which four receptacle connectors 5 according to the first embodiment are integrally arranged in a row in the connector width direction.

This application is based upon and claims the benefit of priority from Japanese patent application No. 2014-45241, filed on Mar. 7, 2014, the disclosure of which is incorporated herein in its entirety by reference.

REFERENCE SIGNS LIST

1 CONNECTOR ASSEMBLY
2 PLUG-SIDE WIRE
3 RECEPTACLE-SIDE WIRE
4 PLUG CONNECTOR (FIRST CONNECTOR)
5 RECEPTACLE CONNECTOR (SECOND CONNECTOR)
6 PLUG CONTACT (FIRST CONTACT)
7 PLUG HOUSING (FIRST HOUSING)
8 RECEPTACLE CONTACT (SECOND CONTACT)
9 RECEPTACLE HOUSING (SECOND HOUSING)
10 PLATE-SHAPED CONTACT PORTION (PLATE-SHAPED CONTACT PORTION)
10A LEADING END
10B SIDE END
10C TRAILING END
10D UPPER CONTACT SURFACE (FIRST CONTACT SURFACE)
10E LOWER CONTACT SURFACE (SECOND CONTACT SURFACE)
10 MOVEMENT REGULATING PORTION
11A FIRST MOVEMENT REGULATING SURFACE
11B SECOND MOVEMENT REGULATING SURFACE
12 CRIMPING PORTION
13 COUPLING PORTION
14 LOWER CONTACT PORTION
15 UPPER CONTACT PORTION
16 FOLD
17 REGULATION PIECE
20 CONTACT ACCOMMODATING PORTION
21 CRIMPING PORTION ACCOMMODATING PORTION
22 BASE (FIRST HOUSING BODY)
22A BASE SURFACE
23 INSIDE COVER
24 OUTSIDE COVER (HOUSING COVER PORTION)
25 INSERTION OPENING
26 SIDE END COVER PORTION
26A LEADING END
27 LEADING END COVER PORTION
27A LEADING END COVER SURFACE
27B MIDDLE PORTION
28 BEAM
29 TOP PLATE
30 LANCE
31 LANCE BODY
32 CLAW
40 SPRING PIECE HOLDING PORTION
41 UPPER ELASTIC SPRING PIECE (FIRST ELASTIC SPRING PIECE)
42 LOWER ELASTIC SPRING PIECE (SECOND ELASTIC SPRING PIECE)
43 CRIMPING PORTION
44 COUPLING PORTION
48 TOP PLATE
48A LEADING END
49 BOTTOM PLATE
49A LEADING END
50 SIDE PLATE
51 LOCK HOLE
52 SLIT
55 PROXIMAL END PORTION
56 ELASTIC SPRING PIECE
57 CURVED PORTION
58 EASILY DEFORMABLE PORTION
59 CONTACT PORTION
60 PROXIMAL END PORTION
61 ELASTIC SPRING PIECE
62 CURVED PORTION
63 EASILY DEFORMABLE PORTION
64 CONTACT PORTION
65 CYLINDER PORTION
70 TOP PLATE
70A LEADING END
71 BOTTOM PLATE
71A LEADING END
72 SIDE PLATE
73 LID PORTION
73A UPPER SPRING PIECE COVER PORTION (FIRST ELASTIC SPRING PIECE COVER PORTION)
73B LOWER SPRING PIECE COVER PORTION
74 LANCE
75 TOP PLATE KEY
76 LANCE BODY
77 CLAW
78 BOTTOM PLATE KEY
79 OPENING
80 PLUG-SIDE MATING LOCK CLAW
81 RECEPTACLE-SIDE MATING LOCK CLAW
90 CONNECTOR ASSEMBLY
91 PLUG CONNECTOR
92 RECEPTACLE CONNECTOR
93 CONNECTOR ASSEMBLY
94 PLUG CONNECTOR
95 RECEPTACLE CONNECTOR
D1 DISTANCE
D2 DISTANCE
E1 GAP
E2 GAP
F FINGER
M METALLIC PLATE
N METALLIC PLATE
P1 WIDTH DIMENSION
P2 WIDTH DIMENSION
S INSERTION SPACE
R ACCOMMODATION SPACE
T ACCOMMODATION SPACE
W WIDTH DIMENSION

The invention claimed is:

1. A connector assembly comprising:

a first connector including a first housing and a first contact held in the first housing; and a second connector including a second housing and a second contact held in the second housing, the first connector being mated to the second connector to electrically connect the first contact with the second contact, wherein the first contact includes a plate-shaped contact portion parallel to a mating direction in which the first connector is mated to the second connector, the contact portion has a first contact surface where the second contact is contactable, the first housing includes: a first housing body; a pair of side end cover portions that projects in the mating direction from the first housing body and covers both side ends of the contact portion; a leading end cover portion that couples leading ends of the pair of side end cover portions in the mating direction and covers a leading end of the contact portion; a beam that couples the first housing body with a middle portion of the leading end cover portion in a longitudinal direction; and a housing cover portion that covers the second housing in a state where the first connector is mated to the second connector, the second contact includes a pair of first elastic spring pieces that is contactable with the first contact surface and is disposed in such a manner that the first elastic spring pieces sandwich the beam in the state where the first connector is mated to the second connector, and the second contact is formed by bending a single metallic plate.

2. The connector assembly according to claim 1, wherein the contact portion includes a second contact surface which is a surface opposite to the first contact surface, the second contact includes a pair of second elastic spring pieces contactable with the second contact surface, and the pair of first elastic spring pieces and the pair of second elastic spring pieces are opposed to each other in a state before the first connector is mated to the second connector.

3. The connector assembly according to claim 2, wherein the contact portion is formed by folding the metallic plate back.

4. The connector assembly according to claim 3, wherein in the contact portion, a fold formed by folding the metallic plate is parallel to the mating direction.

5. The connector assembly according to claim 3, wherein in the contact portion, a fold formed by folding the metallic plate is orthogonal to the mating direction.

6. The connector assembly according to claim 1, wherein the first contact further includes a movement regulating portion that projects in a thickness direction of the contact portion, and when the first contact moves in the mating direction relative to the first housing and the movement regulating portion contacts the first housing, the movement regulating portion inhibits a further movement of the first contact in the mating direction relative to the first housing, and when the first contact moves in a direction opposite to the mating direction relative to the first housing and the movement regulating portion contacts the first housing, the movement regulating portion inhibits a further movement of the first contact in the direction opposite to the mating direction relative to the first housing.

7. The connector assembly according to claim 6, wherein when the first contact moves in the mating direction relative to the first housing and the movement regulating portion contacts the first housing, a distance from the movement regulating portion to the leading end cover portion is larger than a distance from the movement regulating portion to the leading end of the contact portion.

8. The connector assembly according to claim 1, wherein at least one of the pair of first elastic spring pieces includes at least two elastic spring pieces contactable with the first contact surface.

9. The connector assembly according to claim 1, wherein the second housing includes:

a cylinder portion including an accommodation space that extends in the mating direction and accommodates the second contact; and a lid portion that partitions the accommodation space in a direction opposite to the mating direction, the lid portion has an opening for inserting the first contact, the pair of side end cover portions, the leading end cover portion, and the beam into the accommodation space, and the lid portion includes a pair of first elastic spring piece cover portions that is opposed to the pair of first elastic spring pieces in the mating direction.

* * * * *